US011538310B2

(12) United States Patent
Hendricks et al.

(10) Patent No.: US 11,538,310 B2
(45) Date of Patent: Dec. 27, 2022

(54) MULTI-LEVEL WHEEL WITH SECONDARY WHEELS CORRESPONDING TO OUTCOMES TO THE PRIMARY WHEEL

(71) Applicant: Aristocrat Technologies, Inc., Las Vegas, NV (US)

(72) Inventors: Bradley Hendricks, Las Vegas, NV (US); Thomas Tuomey, Las Vegas, NV (US); Gary Penacho, Henderson, NV (US); Damien Burczyk, Henderson, NV (US); Allon Englman, Las Vegas, NV (US)

(73) Assignee: ARISTOCRAT TECHNOLOGIES, INC., Las Vegas, NV (US)

( * ) Notice: Subject to any disclaimer, the term of this patent is extended or adjusted under 35 U.S.C. 154(b) by 0 days.

(21) Appl. No.: 17/459,646

(22) Filed: Aug. 27, 2021

(65) Prior Publication Data

US 2022/0051526 A1 Feb. 17, 2022

Related U.S. Application Data

(63) Continuation of application No. 16/569,498, filed on Sep. 12, 2019, now Pat. No. 11,107,326.
(Continued)

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
None
See application file for complete search history.

(56) References Cited

U.S. PATENT DOCUMENTS 6,048,269 A 4/2000 Burns
6,142,876 A 11/2000 Cumbers
(Continued)

FOREIGN PATENT DOCUMENTS

WO 2005026909 3/2005

OTHER PUBLICATIONS

Schneier, "Applied Cryptography, Protocols, Algorithms, and Source Code in C," 2nd Edition, John Wiley & Sons, Inc., 662 pp. (1996).
(Continued)

*Primary Examiner* — Jason T Yen
(74) *Attorney, Agent, or Firm* — Blank Rome LLP

(57) ABSTRACT

Embodiments of the disclosed technology comprise advancements to electronic gaming machines. In particular embodiments, when a bonus feature is activated and, as part of the bonus feature, a sub-feature is selected from among multiple available sub-features. The bonus feature can include one or more sub-features that trigger a further secondary RNG selection. For example, the one or more sub-features can include one or more of (a) a credit awarding secondary feature in which a secondary RNG is applied to select the amount of credits; (b) a free-spin secondary feature in which one or more free games can be awarded; and/or (c) a reel-spin feature in which an enhanced reward scheme is applied. In further embodiments, the reel-spin feature can further include a random selection of a threshold that ensures the player the threshold amount until it is exceeded by the game mechanics.

20 Claims, 28 Drawing Sheets

Related U.S. Application Data

(60) Provisional application No. 62/894,841, filed on Sep. 1, 2019, provisional application No. 62/734,252, filed on Sep. 20, 2018.

(56) References Cited

U.S. PATENT DOCUMENTS

| | | | | |
|---|---|---|---|---|
| 8,932,129 | B2 | 1/2015 | Powell | |
| 2002/0022509 | A1* | 2/2002 | Nicastro, II | G07F 17/3267 463/15 |
| 2003/0027628 | A1* | 2/2003 | Luciano | G07F 17/32 463/20 |
| 2006/0287077 | A1 | 12/2006 | Grav | |
| 2007/0026935 | A1 | 2/2007 | Wolf | |
| 2011/0218027 | A1* | 9/2011 | Manz | G07F 17/3213 463/19 |
| 2016/0300454 | A1* | 10/2016 | Uss | G07F 17/3288 |
| 2017/0092058 | A1* | 3/2017 | Saravanan | G07F 17/3211 |
| 2017/0132872 | A1* | 5/2017 | Berman | G07F 17/3244 |
| 2017/0193756 | A1* | 7/2017 | Schmidt | G07F 17/34 |
| 2019/0213837 | A1* | 7/2019 | Pawlak | G07F 17/3288 |

OTHER PUBLICATIONS

Office Action dated Jan. 11, 2021 for U.S. Appl. No. 16/569,498 (pp. 1-13).

Notice of Allowance dated May 12, 2021 for U.S. Appl. No. 16/569,498 (pp. 1-11).

* cited by examiner

500

700

701

703

900

910

901

920

903

930

904

940

905

950

906

960

907

970

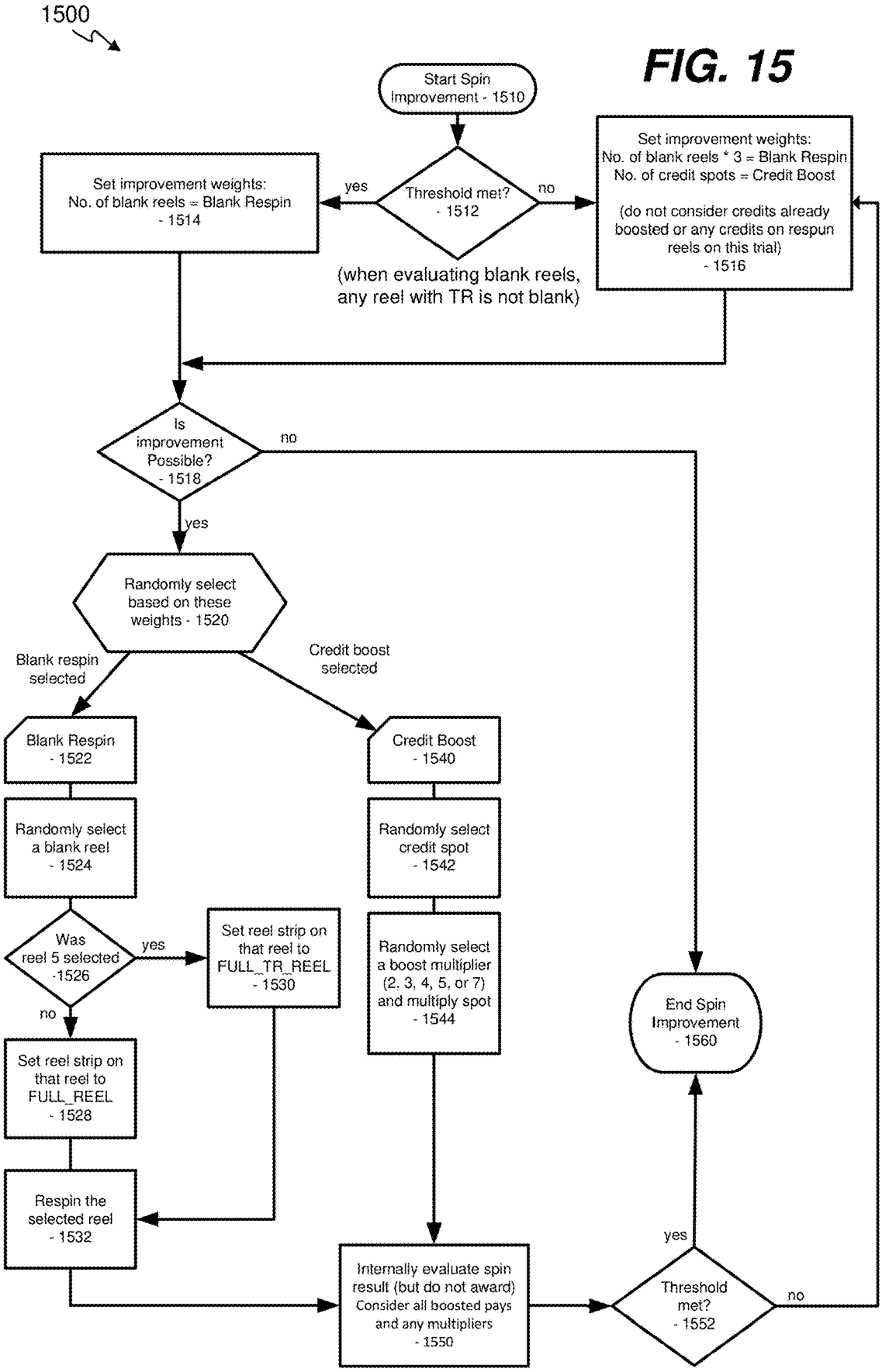
1500
FIG. 15
Start Spin Improvement - 1510
Threshold met? - 1512
yes
no
(when evaluating blank reels, any reel with TR is not blank)
Set improvement weights: No. of blank reels = Blank Respin - 1514
Set improvement weights: No. of blank reels * 3 = Blank Respin No. of credit spots = Credit Boost
(do not consider credits already boosted or any credits on respun reels on this trial) - 1516
Is improvement Possible? - 1518
no
yes
Randomly select based on these weights - 1520
Blank respin selected
Credit boost selected
Blank Respin - 1522
Randomly select a blank reel - 1524
Was reel 5 selected -1526
yes
no
Set reel strip on that reel to FULL_TR_REEL - 1530
Set reel strip on that reel to FULL_REEL - 1528
Respin the selected reel - 1532
Credit Boost - 1540
Randomly select credit spot - 1542
Randomly select a boost multiplier (2, 3, 4, 5, or 7) and multiply spot - 1544
End Spin Improvement - 1560
Internally evaluate spin result (but do not award) Consider all boosted pays and any multipliers - 1550
Threshold met? - 1552
yes
no

MULTI-LEVEL WHEEL WITH SECONDARY WHEELS CORRESPONDING TO OUTCOMES TO THE PRIMARY WHEEL

CROSS REFERENCE TO RELATED APPLICATION

This patent application is a continuation of U.S. patent application Ser. No. 16/569,498, entitled "MULTI-LEVEL WHEEL WITH SECONDARY WHEELS CORRESPONDING TO OUTCOMES TO THE PRIMARY WHEEL," filed Sep. 12, 2019, which claims the benefit of U.S. Provisional Patent Application No. 62/734,252, entitled "MULTI-LEVEL WHEEL WITH SECONDARY WHEELS CORRESPONDING TO OUTCOMES TO THE PRIMARY WHEEL," filed Sep. 20, 2018, and which claims the benefit of U.S. Provisional Patent Application No. 62/894,841, entitled "MULTI-LEVEL WHEEL WITH SECONDARY WHEELS CORRESPONDING TO OUTCOMES TO THE PRIMARY WHEEL," filed Sep. 1, 2019, the disclosures of which are hereby incorporated by reference in their entirety.

TECHNICAL FIELD

This application concerns electronic gaming machines ("EGMs"), and in particular to a feature-control mechanism having multiple stages for selecting and awarding one or more game sub-features and outcomes from those sub-features.

BACKGROUND

EGMs provide a variety of wagering games such as slot games, video poker games, video blackjack games, roulette games, video bingo games, keno games and other types of games, which are frequently offered at casinos and other locations for use by players. Play on an EGM typically involves a player establishing a credit balance by inputting money, or another form of monetary credit, and placing a wager (from the credit balance) on one or more outcomes of an instance (or single play) of a primary or base game. In some cases, a player may qualify for a special mode of the base game, a secondary game (which refers to a secondary feature, as any outcome will be awarded to a player as part of a single game instance), or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

A "slot" type game is often presented to a player in the form of various symbols arrayed in a row-by-column grid (matrix). Specific matching combinations of symbols along predetermined paths (or "pay lines") through the matrix indicate the outcome of the game. The display typically highlights winning combinations/outcomes for ready identification by the player. Matching combinations and their corresponding awards are usually shown in a "pay table," which is available to the player for reference. Often, the player may vary his/her wager to include differing numbers of pay lines and/or the amount bet on each line. By varying the wager, the player may sometimes alter the frequency or number of winning combinations, frequency or number of secondary games, and/or the amount awarded.

Typically, a game uses a random number generator ("RNG") to randomly determine the outcome of the game. A game is designed to return a certain percentage of the amount wagered back to a player over the course of many plays or instances of the game, which is generally referred to as return to player ("RTP"). The RTP and randomness of the RNG ensure the fairness of games and are highly regulated. For example, upon initiation of play, an RNG may randomly determine a game outcome, and symbols are selected which correspond to that outcome. Notably, some games may include an element of skill on the part of the player and are therefore not entirely random.

EGMs depend on usability to enhance the user experience and extend user time on the EGMs (in this disclosure, the terms "player" and "user" are used interchangeably). Although previous EGMs include various UI features, and backend operations associated with the UI features, that improve usability and enhance the user experience, there is room for further improvement to EGMs.

SUMMARY

In summary, the detailed description presents innovations for a feature-control mechanism having multiple stages for selecting and awarding one or more game sub-features and outcomes from those sub-features.

The innovations can be implemented as part of a method, as part of an electronic gaming device such as an EGM or electronic gaming server configured to perform the method, or as part of non-transitory computer-readable media storing computer-executable instructions for causing one or more processors in a computer system to perform the method. The various innovations can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the invention will become more apparent from the following detailed description, which proceeds with reference to the accompanying figures and illustrates a number of examples. Examples may also be capable of other and different applications, and some details may be modified in various respects all without departing from the spirit and scope of the disclosed innovations.

Some embodiments comprise back-end server systems or front-end EGMs that comprise a system comprising: one or more processors; memory; and control logic, implemented using the one or more processors and memory, configured to perform operations to control an electronic gaming machine ("EGM"), the operations comprising: receiving an indication that a multi-level feature has been triggered at an EGM; in a first level of the multi-level feature, selecting, using a random number generator, a second-level sub-feature or award to be awarded to a user from among two or more available second-level sub-features or awards; in a second level of the multi-level feature, and based on the selected second-level sub-feature or award, selecting, using a random number generator, an outcome from among multiple outcomes of the second level of the multi-level feature, the outcome being selected from multiple outcomes that are unique to the selected second-level feature or award and distinct from other ones of the two or more second-level sub-features or awards selected in the first level. The recited features can also be implemented as a method performed by a server or EGM.

Further embodiments comprise back-end server systems or front-end EGMs that comprise a system comprising: one or more processors; and memory, readable by the one or more processor and comprising instructions stored thereon to cause the one or more processors to: trigger bonus feature based on an outcome of a primary game; select a first-level outcome from among multiple outcomes for the bonus feature; select a second-level outcome based on the first-level outcome; determine if the first-level outcome resulted in a terminating event; enhance one or more possible awards provided by the bonus feature upon determining that the first-level outcome did not result in the terminating event; and re-perform at least a portion of the bonus feature with the enhanced one or more possible awards.

BRIEF DESCRIPTION OF THE DRAWINGS

The following drawings illustrate some features of the disclosed innovations. The drawings are not necessarily drawn to scale.

FIGS. 10-15 are flowcharts illustrating example techniques for performing embodiments of the disclosed technology.

DETAILED DESCRIPTION

I. General Considerations

Figure 1:
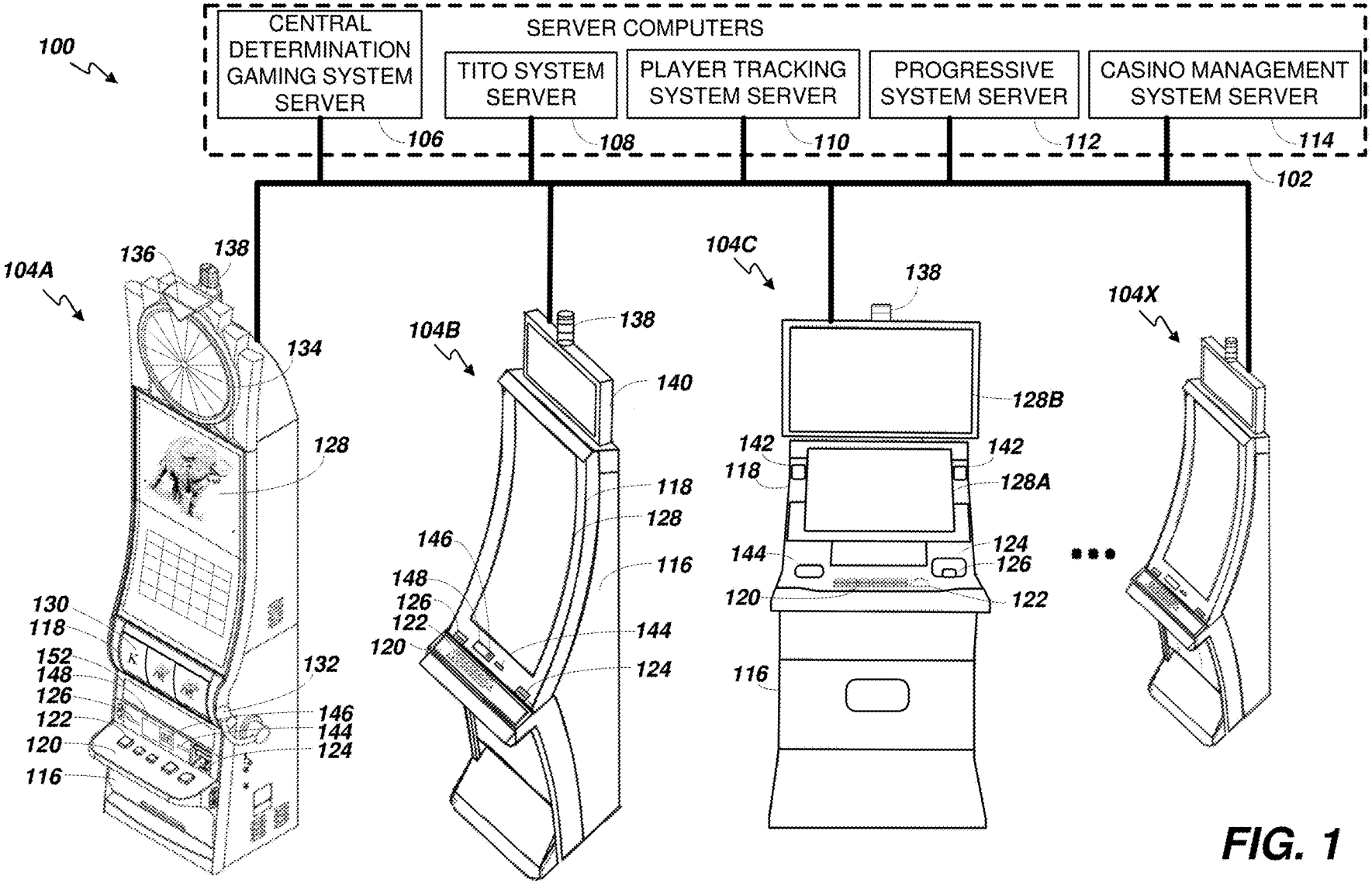
FIG. 1 is a perspective diagram of example EGMs according to some embodiments.

The detailed description presents innovations electronic gaming machines ("EGMs"). In the examples described herein, identical reference numbers in different figures indicate an identical component, module, or operation. More generally, various alternatives to the examples described herein are possible. For example, some of the methods described herein can be altered by changing the ordering of the method acts described, by splitting, repeating, or omitting certain method acts, etc. The various aspects of the disclosed technology can be used in combination or separately. Some of the innovations described herein address one or more of the problems noted in the background. Typically, a given technique/tool does not solve all such problems. It is to be understood that other examples may be utilized and that structural, logical, software, hardware, and electrical changes may be made without departing from the scope of the disclosure. The following description is, therefore, not to be taken in a limited sense. Rather, the scope of the present disclosure is defined by the appended claims.

II. Overview

Embodiments of the disclosed technology comprise advancements to gaming. In particular embodiments, a player initiates a base game with a selected bet. The base game results are selected by an RNG and a determination is made as to whether a bonus feature has been achieved. For example, one or more bonus symbols may be selected in the base game to trigger a bonus feature. When the bonus feature is activated and, as part of the bonus feature, a sub-feature is selected from among multiple available sub-features. The bonus feature can include one or more sub-features that trigger a further secondary RNG selection. For example, the one or more sub-features can include one or more of (a) a credit awarding secondary feature in which a secondary RNG is applied to select the amount of credits; (b) a free-spin secondary feature in which one or more free games can be awarded; and/or (c) a reel-spin feature in which an enhanced reward scheme is applied.

The outcome of the selected sub-feature is determined and presented to the player. In particular embodiments, the determined sub-feature is activated and a resulting outcome is selected (e.g., using an RNG applying a lookup table (also referenced as a probability table), which may be weighted (as described below)). Subsequently, a display of the determined result of the sub-feature is activated. A determination can then be made as to whether the sub-feature selected is a terminating sub-feature (indicating that the bonus feature is to be terminated, and a return to the base reel game (after awarding any bonus feature credits are awarded) is to be executed). If a terminating sub-feature has not been selected, then the procedure continues where one or more modifications are made to the primary wheel, which awards the sub-features. For instance, one or more of the available sub-features are altered to provide greater (enhanced) awards. In particular embodiments, the upgrades include upgraded multipliers for the credit awarding sub-features and/or upgraded reel strips for one or more bonus features. The number of possible upgrades can be limited, such that only n upgrades are possible (where n is any integer number, but may be set to have a limit, in which no further upgrades are available). In the event that a terminating sub-feature (or event) is reached, then the particular game instance of the base reel game is completed and any base reel game and bonus feature awards are awarded to the player and added to the player's credit meter.

In particular embodiments, one of the selected sub-features can be a reel-spin feature that implements one or more respin operations. To determine whether a respin operation occurs, the reel-spin feature utilizes a random selection of a credit threshold to represent a minimum award value the reel-spin feature should achieve before exiting out of the feature. In other words, the reel-spin feature can perform at least one respin of one or more of the reels until the payout for the reel-spin feature meets or exceeds the determined credit threshold.

In some embodiments, a re-spin is performed on certain selected reels but not all reels. For example, the re-spin can be performed on a single reel or multiple reels (but not all) depending on a particular re-spin factor. The re-spin factor can be, for example, whether the initial spin for a particular reel resulted in an award. Still further, in particular embodiments, the underlying reel strip applied to any eligible re-spin reel can be modified to include a different probability for success (e.g., the eligible re-spin reel can be enhanced to guarantee that at least one award symbol will appear after the RNG selects the outcome for the reel).

In certain embodiments, the credit threshold is selected to achieve (on average) a certain average award. In doing so, the credit threshold acts as a mechanism to achieve any relevant regulatory requirements. The credit threshold may be selected, for instance, using a variety of probabilities within a range of possible outcomes, both designed to generate over time an average award. This approach can cluster wins around a desired average award. As described below, during the sub-feature, if the actual award amount is less than the credit threshold value, then the sub-feature can perform at least one respin to ensure that the actual award exceeds the credit threshold value. The credit threshold value can be dynamically set for each activation of the sub-feature; in other words, the threshold value can vary each time a player enters the sub-feature.

III. Example Electronic Gaming Servers and Electronic Gaming Machines

FIG. 1 illustrates several different models of EGMs which may be networked to various gaming-related servers. Shown is a system 100 in a gaming environment including one or more server computers 102 (e.g., slot servers of a casino) that are in communication, via a communications network, with one or more gaming devices 104A-104X that have communication interfaces with the network. The server computers 102 and/or gaming devices 104A-104X can implement one or more aspects of the present disclosure.

The gaming devices 104A-104X may be EGMs such as slot machines, video poker machines, bingo machines, etc. The gaming devices 104A-104X may alternatively be portable and/or remote gaming devices such as, but not limited to, a smartphone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency ("RF") (e.g., wireless fidelity (WiFi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. In this case, functions normally performed by a server computer or data normally stored on a server computer may instead be performed by or stored on a gaming device. The stand-alone gaming device may be in communication with one or more other gaming devices (but not a server computer). However, it is typical to find multiple EGMs connected to networks implemented with one or more of the different server computers 102 described herein.

III.A. Example Server Computers.

Server computers 102 can include one or more servers that combine to form a casino management system, which manages one or more gaming devices 104A-X. Each of the servers includes at least one processor, memory, and a network interface, which enables communication over one or more networks between the server computers 102 and the gaming devices 104A-X. In general, the casino management system is configured to receive gaming data from the gaming devices 104A-X as the gaming devices 104A-X conduct rounds of play of one or more wagering games.

As shown in FIG. 1, the server computers 102 may include a central determination gaming system server 106 (also called a gaming server), a ticket-in-ticket-out ("TITO") system server 108, a player tracking system server 110, a progressive system server 112, and/or a casino management system server 114. Gaming devices 104A-104X may include features to enable operation of any or all server computers 102 for use by the player and/or operator (e.g., the casino, resort, gaming establishment, tavern, pub, etc.). For example, game outcomes may be generated on a central determination gaming system server 106 and then transmitted over a network to any of a group of remote terminals or remote gaming devices 104A-104X that utilize the game outcomes and display the results to the players.

FIG. 1 shows different servers that perform different sets of functions. Alternatively, one or more of the different servers shown in FIG. 1 can be combined.

III.B. Example Gaming Devices.

Still referring to FIG. 1, the gaming devices 104A-C illustrated are specific exemplary embodiments of EGMs, and the same or similar elements shown in gaming devices 104A-C may be included in any gaming device 104X. More generally, an EGM may be any type of gaming machine and may include, without limitation, different structures than those shown in FIG. 1. A gaming device may use specially-configured computer hardware that implements game functionality, or a gaming device may use general-purpose computer hardware that has been programmed to implement game functionality. For example, an EGM can be implemented using a personal computer, tablet computer, smartphone, personal digital assistant, or any other computing device.

Gaming device 104A is often of a cabinet construction which may be aligned in rows or banks of similar devices for placement and operation on a casino floor. The gaming device 104A often includes a main door which provides access to the interior of the cabinet 116. Gaming device 104A typically includes a button area or button deck 120 accessible by a player that is configured with input switches or buttons 122, an access channel for a bill validator 124, and/or an access channel for a ticket-out printer 126. The input switches or buttons 122, along with other input devices, provide at least part of a player interface through which a player controls operation of a game. For example, buttons 122 may be used to start play of a primary game or secondary game. Alternatively, instead of having separate buttons that can be actuated physically, one or more of the buttons 122 can be presented on a touchscreen.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube ("CRT"), or other conventional electronically controlled video monitor. Alternatively, the main display 128 can be a touchscreen display. The main display 128 is an interface component used to play a game on the gaming device 104A.

In some embodiments, the bill validator 124 may also function as a "ticket-in" reader that allows the player to use a casino issued credit ticket to load credits onto the gaming device 104A (e.g., in a cashless ticket (TITO) system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152, which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116, which may be used to initiate game play. In general, a "handle pull" or "spin" of a game may refer to a single play at a gaming device, whether or not a handle is involved in the play, and whether or not a handle is even included in the gaming device. Thus, a play can be initiated by a press of a physical or virtual button, or via another activation mechanism.

Figure 2:
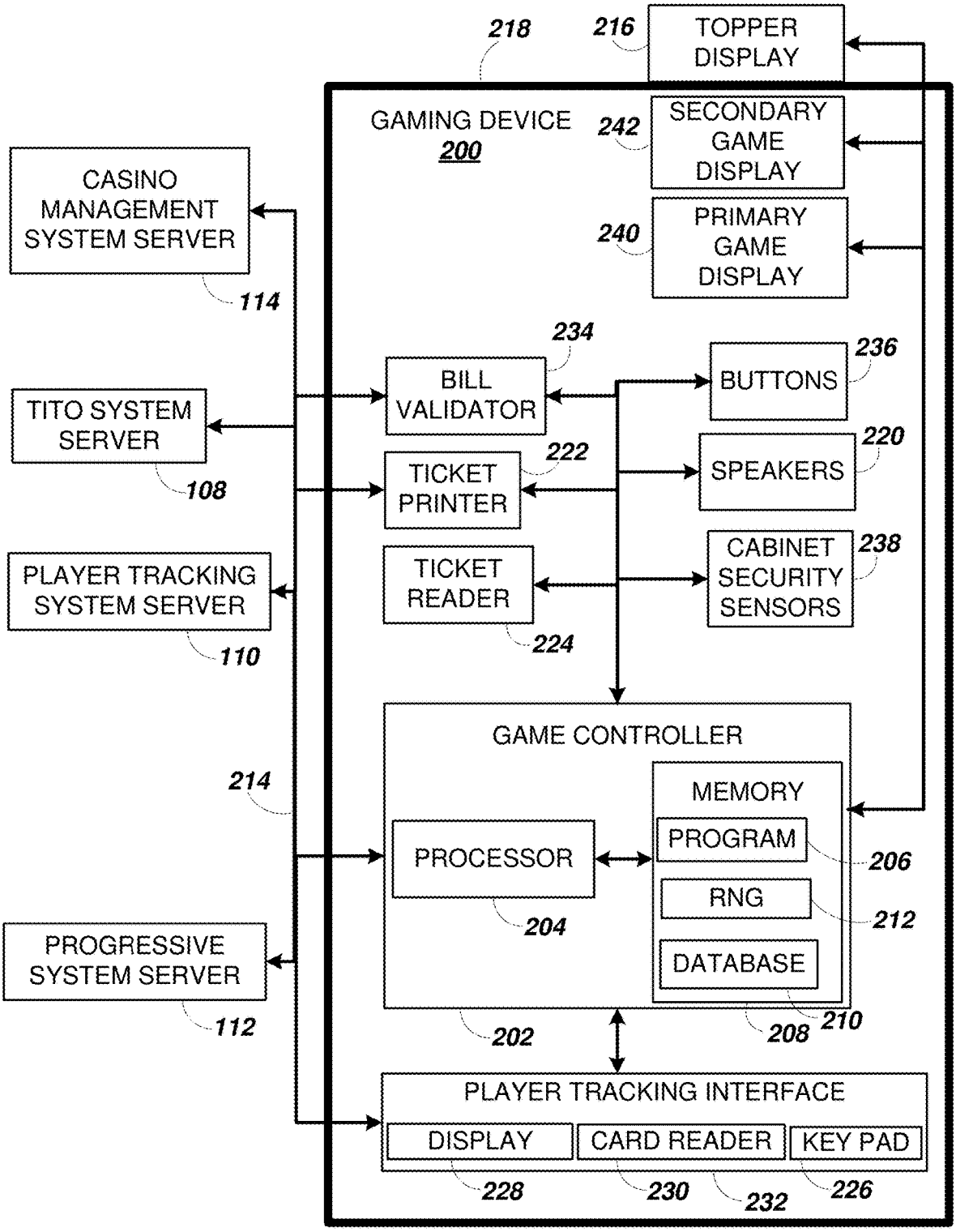
FIG. 2 is a block diagram illustrating an example of a networked EGM according to some embodiments.

Many or all the above described components can be controlled by circuitry (e.g., a gaming controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. The main display 128 is in a portrait orientation with curvature radius from top to bottom. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Where possible, reference numerals identifying similar features of the embodiments of gaming devices 104A and 104B are used to identify corresponding features of gaming device 104C.

Gaming device 104C does not include physical reels and instead shows game play functions on main display 128A and a secondary display 128B. Gaming device 104C includes a main display 128A that is in a landscape orientation. The main display 128A or secondary display 128B can be a high-resolution LCD, plasma, LED, OLED, or SED panel, Although not illustrated by the front view provided, the landscape display 128A may have a curvature radius from top to bottom, or alternatively from side to side. In some embodiments, display 128A is a flat panel display. Alternatively, the main display 128A can be a touchscreen display. Main display 128A is typically used for primary game play while secondary display 128B is typically used for bonus game play, to show game features or attraction activities while the game is not in play or any other information or media desired by the game designer or operator. The secondary display 128B may be in a landscape orientation with curvature radius from top to bottom, or may be flat. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

III.C. Example Components of Gaming Device.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1.

As shown in FIG. 2, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smartphone enabling player tracking. FIG. 2 also depicts utilizing a ticket printer 222 to print tickets for a TITO system server 108. Gaming device 200 may further include a bill validator 234, player-input buttons 236 for player input, and cabinet security sensors 238 to detect unauthorized opening of the cabinet 218, each coupled to and operable under the control of game controller 202. The game controller 202 may be a circuit (e.g., an electronic circuit board, a programmable computer chip, etc.) within a gaming device that, in addition to controlling other components, includes one or more processors that process game play instructions in accordance with game play rules, and outputs or generates game play outcomes to one or more displays.

The gaming device 200 includes several display screens, each coupled to and operable under the control of the game controller 202. A primary game display 240 acts as a main display 128, 128A as described with reference to FIG. 1. A secondary game display 242 acts as a secondary display 128B as described with reference to FIG. 1. The gaming device 200 can include a credit display that displays a player's current number of credits, cash, account balance, or the equivalent. The gaming device 200 can also include a bet display that displays a player's amount wagered. The credit display and/or bet display may be standalone displays, independent of the primary game display 240 and secondary game display 242. Alternatively, the credit display and/or bet display can be incorporated into the primary game display 240 or secondary game display 242. Any of the display screens can be implemented as a touchscreen, with an associated touchscreen controller. In this case, such display screens may be operated as input devices in addition to presenting information, to provide input game play decisions (e.g., actions on and selection of game presentation objects).

The games available for play on the gaming device 200 are controlled by a game controller 202. In general, the game controller 202 conducts a wagering game, generates gaming data (e.g., for wagers, game outcomes, payouts, player ratings, duration of play, and time between rounds of play), and, for each round of play of the wagering game, awards a payout or win amount according to a pay table. A base game can include a bonus game that the game controller 202 also conducts. The game controller 202 determines an outcome of the process and outputs an indication of the outcome of the process. For example, the game controller 202 determines whether any win conditions exist (on pay lines) and awards win amounts to the player. More generally, the game controller 202 can process game play instructions and generate outcomes as described below.

The game controller 202 includes one or more processors 204. Processor 204 represents a general-purpose processor, a specialized processor intended to perform certain functional tasks, or a combination thereof. As an example, processor 204 can be a central processing unit ("CPU") that has one or more multi-core processing units and memory mediums (e.g., cache memory) that function as buffers and/or temporary storage for data. Alternatively, processor 204 can be a specialized processor, such as an application specific integrated circuit ("ASIC"), graphics processing unit ("GPU"), field-programmable gate array ("FPGA"), digital signal processor ("DSP"), or another type of hardware accelerator. In another example, processor 204 is a system on chip ("SoC") that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory ("RAM"), read-only memory ("ROM"), hard disk drives, solid-state drives, universal serial bus ("USB") flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory ("SRAM"), dynamic random access memory ("DRAM"), magnetic random access memory ("MRAM"), and other such devices. Examples of ROM include a programmable read-only memory ("PROM"), an erasable programmable read-only memory ("EPROM"), an electrically erasable programmable read-only memory ("EEPROM"), or other like memory device. Even though FIG. 2 illustrates that game controller 202 includes a single memory 208, game controller 208 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchange with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via a UI) to a player. Output for the game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a ROM) or from the central determination gaming system server 106 to memory 208.

When games are implemented in an online environment, at least a portion of the game software can be stored in a remote game server or in a cloud computing service. Game transactions such as adding money to the game (i.e., cash in) and withdrawing money from the game (i.e., cash out) are substituted by implementing electronic fund transfers. A player deposits money into his online gaming account via checks, debit cards, wire and the like. Once funded, the player can move a portion of the cash in his account into the game he wants to play. This process is referred to as account-based wagering. Account-based wagering is a convenient monetary transaction system for online and mobile wagering environments since the physical bill acceptor and ticket printer are not available. In addition to the accounting meters' separation, detection of the location where the wagering transaction take place is also performed in order to enforce local gaming regulations and properly calculate revenue, profit, and tax withholdings, for example. Thus, a remote gaming device can access a casino via a computer network and participate in a game of chance. The remote gaming device may be a PC, smartphone, or other computing device coupled to the Internet via a wired or wireless link (and, e.g., connecting to a casino management system via a virtual private network). The remote gaming device may be a terminal-based machine, where the actual game (including RNG and outcome determination) is hosted at a gaming server, with the terminal-based machine displaying results of the game via one or more display screens.

The game controller 202 can communicate over a network with one or more other gaming devices or other devices via a communication interface. The communication interface may operate as an input device (e.g., by receiving data from another device) and/or as an output device (e.g., by transmitting data to another device). The gaming device 200 can also include one or more communication ports that enable the game controller 202 to communicate with peripheral devices, external video sources, expansion buses, or display screens.

FIG. 2 depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or selecting various items during a feature game). The player may make these selections using the player-input buttons 236, the primary game display 240 which may be a touchscreen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Some embodiments described herein represent improvements in the technical area of EGM software and provide new technology, in that they improve usability of EGMs by enhancing the user experience, extending player time on the EGMs, and maintaining the interest of current users in the EGMs.

Gaming devices such as gaming device 200 (as a generalized example of devices 104A-X) typically include special features and/or additional circuitry that differentiates them from general-purpose computers (e.g., desktop computers and laptops). Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness (e.g., that outcomes will be statistically independent, uniformly distributed over their range, unpredictable and pass statistical tests such as chi-square test, equi-distribution test, gap test, runs test, serial correlation test, etc.). Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG 212 can be integrated into the game controller 202 or processor 204. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. (Gaming regulations may require that each reel outcome be independent of each other reel outcome, such that no reel outcome depends on any other reel outcome.) In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%).

A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2 illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables (e.g., weighted tables) to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

As noted, gaming devices 200 are specially-configured computer systems and not merely general-purpose computers. For example, one difference between a gaming device 200 and common processor-based computer system is that gaming device 200 is designed to be a state-based system. In a state-based system, the system stores and maintains its current state in non-volatile memory, which can be implemented using battery-backed RAM, flash memory, a solid-state drive, or other persistent memory. Different functions of a game (e.g., bet, play, result, points in the graphical presentation, etc.) may be defined as a state. When a game moves from one state to another, data regarding the game state is stored in a custom non-volatile memory subsystem. In some cases, the gaming device 200 does not advance from a current state to a subsequent state until information that allows the current state to be reconstructed is stored. In the event of a power failure or other malfunction, the gaming device 200 will return to its current state when the power is restored by recovering state information from non-volatile memory. The restored state may include metering information and graphical information that was displayed on the gaming device 200 in the state prior to the malfunction. For instance, if a player was shown an award for a game of chance and, before the award could be provided to the player, the power failed, the gaming device 200, upon the restoration of power, would return to the state where the award is indicated. More generally, the gaming device 200 records, in non-volatile memory, the values of game parameters assigned during play, such as variables determined by an RNG or internal counters. (A game parameter, in general, can be one or more variables whose values govern play at the gaming device and depend on a random selection process.) The value of a game parameter can be recorded periodically, in response to some event such as user input, or whenever the value of the game parameter changes. This way, the gaming device 200 can recover its state in case of a power failure or "tilt" event, allowing the gaming device 200 to reconstruct events that have taken place before the power failure or "tilt" event. In contrast, PCs are not state machines to the same extent, and a majority of data is usually lost when a malfunction occurs. This requirement affects the software and hardware design on a gaming device 200. Game history information regarding previous games played, such as an amount wagered, the outcome of the game and so forth, may also be stored in a non-volatile memory device.

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface).

Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Those of skill in the art will appreciate that embodiments of the present disclosure could be implemented with more or fewer elements than are depicted in FIG. 2. The pictured example embodiments of a gaming device 200, as well as example gaming devices 104A-C, are merely a few examples from a wide range of possible gaming device designs on which embodiments of the present disclosure may be implemented. Depending on implementation and the type of processing desired, components of the gaming device 200 can be added, omitted, split into multiple components, combined with other components, and/or replaced with like components. In alternative embodiments, gaming devices with different components and/or other configurations of components perform one or more of the described techniques. Specific embodiments of gaming devices typically use a variation or supplemented version of the gaming device 200. The relationships shown between components within the gaming device 200 indicate general flows of information in the gaming device 200; other relationships are not shown for the sake of simplicity. In general, the game controller 202 can be implemented by software executable on a CPU, by software controlling special-purpose hardware, or by special-purpose hardware (e.g., in an ASIC).

III.D. Example Game Processing Architecture.

Figure 3:
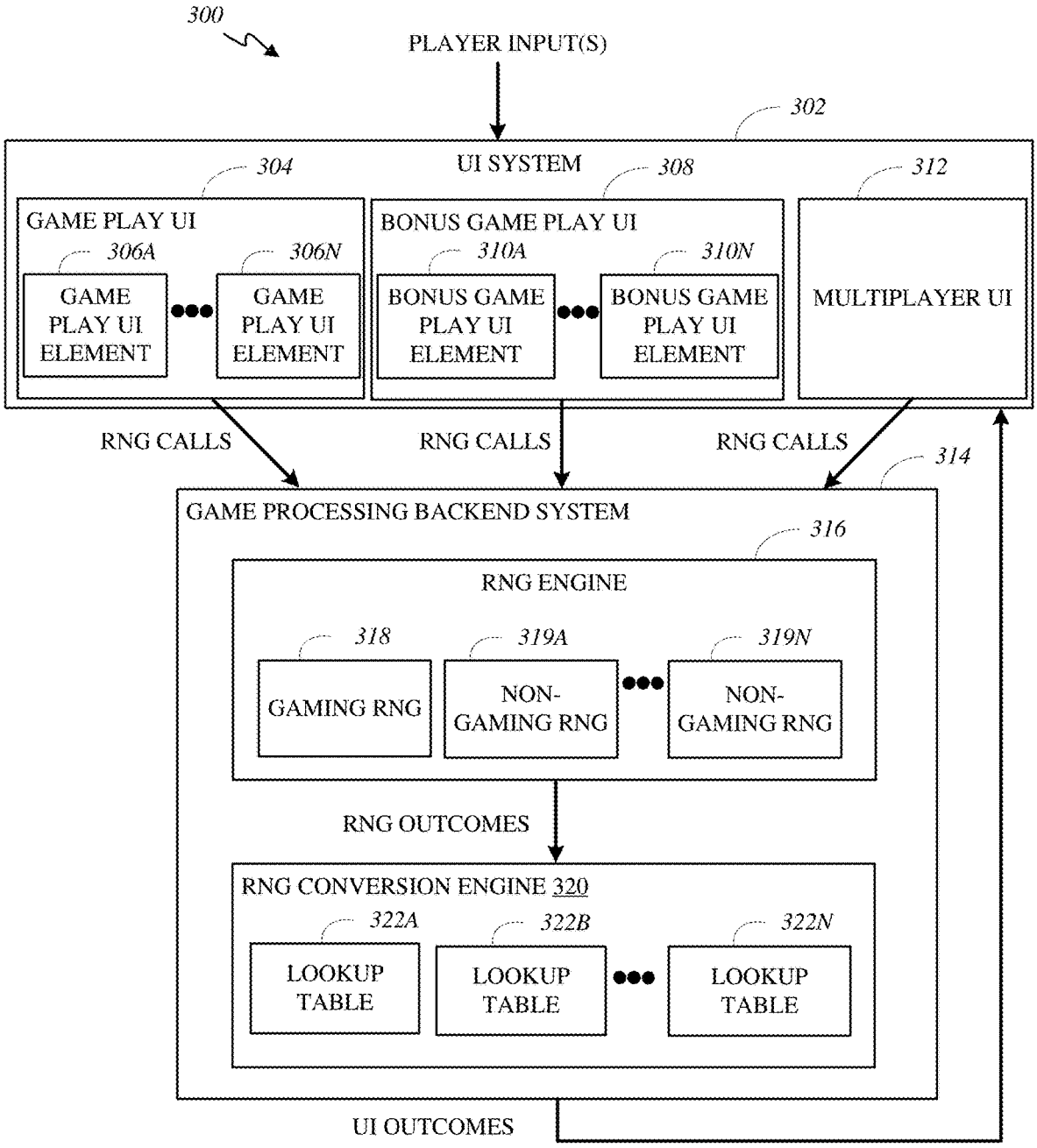
FIG. 3 is a block diagram illustrating an example game processing architecture that implements a game processing pipeline for the play of a game in accordance with some embodiments.

FIG. 3 illustrates, in block diagram form, an example game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes, based on the RNG outcomes, for the UI system 302 to use to control game play (e.g., a display to a player). The game processing architecture 300 can implement the game processing pipeline using a gaming device, such as one of the gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 306, where each UI type includes one or more mechanical UIs and/or graphical UIs (GUIs). In other words, the game play UI 304, bonus game play UI 308, and multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with in a base game. During a game instance of a base game, the game play UI elements 306A-306N (e.g., GUI elements depicting one or more reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from the bonus game play UI elements 310A-310N.

FIG. 3 also illustrates that UI system 302 could include a multiplayer UI 312 purposed for game play that differs or is separate from the typical base game. For example, multiplayer UI 312 could be set up to receive player inputs and/or present game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play.

After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 can generate RNG calls to a game processing backend system 314. As an example, the UI system 302 can use one or more application programming interfaces ("APIs") to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 can be a cryptographic random or pseudorandom number generator ("PRNG") (e.g., Fortuna PRNG) that securely produces random numbers for one or more game features. To generate random numbers, gaming RNG 318 could collect random data from various sources of entropy, such as from an operating system ("OS"). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for purposes such as generating random messages that appear on the gaming device.

The RNG conversion engine 320 processes each RNG outcome from RNG engine 316 and converts the RNG outcome to a UI outcome that is fed back to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. For example, RNG conversion engine 320 utilizes one or more lookup tables 322A-322N (weighted tables) to regulate a prize payout amount for each RNG outcome and how often the gaming device pays out the derived prize payout amounts. In one example, the RNG conversion engine 320 could utilize one lookup table to map the RNG outcome to a game outcome displayed to a player and utilize a second lookup table as a pay table for determining the prize payout amount for each game outcome. In one example, the mapping from the RNG outcome to the game outcome can affect the level of volatility for the game, e.g., by regulating the frequency of occurrence of a game feature such as hitting certain prize payout amounts, triggering a bonus game or special mode, winning a progressive jackpot, etc. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

In general, the example game processing architecture 300 shown in FIG. 3 can be used to process game play instructions and generate outcomes as described below. For example, in some example implementations, the example game processing architecture 300 implements a game processing pipeline for a process that performs any of the multi-level features described below. In response to a start condition, the game play UI 304 (or bonus game play UI 308) makes one or more RNG calls to the game processing backend system 314. In response, the backend system 314 performs various operations. Using a gaming RNG 318, the RNG engine 316 generates one or more random numbers, which are passed to the RNG conversion engine 320. Using the gaming RNG 318, the RNG engine 316 determines more random numbers, which the RNG conversion engine 320 uses (along with one or more of the lookup tables 322A . . . 322N) to determine symbol stop positions for the respective reels of the subset of active reels. The backend system 314 can also determine the outcome of the process (e.g., calculating whether any win conditions exist on pay lines). Eventually, the game play UI 304 (or bonus game play UI 308) stops the spinning of the reels in the subset of active reels at the symbol stop positions returned for the respective reels. Finally, the game play UI 304 (or bonus game play UI 308) outputs an indication of the outcome of the process.

In certain embodiments, the determined sub-feature is activated and a resulting outcome is selected (e.g., using an RNG (such as gaming RNG 318) that applies a lookup table). Subsequently, a display of the determined result of the sub-feature is activated. A determination can then be made as to whether the sub-feature selected is a terminating event (or sub-feature), which indicates that the bonus feature is to be terminated, and a return to the base reel game (after awarding any bonus feature credits are awarded) is to be executed. If a terminating event (sub-feature) has not been selected, then the procedure continues where one or more modifications are made to the primary wheel, which awards the sub-features. For instance, one or more of the available sub-features are altered to provide greater (enhanced) awards. In particular embodiments, the upgrades include upgraded multipliers for the credit awarding sub-features and/or upgraded reel strips for one or more sub-features.

In particular embodiments, one of the selected sub-features can be a reel-spin feature that implements one or more respin operations. To determine whether a respin operation occurs, the reel-spin feature can use a random selection of a credit threshold to represent a minimum award value the reel-spin feature should achieve before exiting out of the feature. The credit threshold can be determined from, for example, by gaming RNG 318 and/or one or more lookup tables 322A-322N). In other words, the reel-spin feature can perform at least one respin of the reels until the payout for the reel-spin feature meets or exceeds the determined credit threshold. In certain embodiments, the credit threshold is selected to achieve (on average) a certain average award. In doing so, the credit threshold acts as a mechanism to achieve any relevant regulatory requirements. The credit threshold may be selected, for instance, using a variety of probabilities within a range of possible outcomes (e.g., using weights from lookup tables), both designed to generate over time an average award. This approach can cluster wins around a desired average award.

As described below, during the sub-feature, if the actual award amount is less than the credit threshold value, then the sub-feature can perform at least one respin (e.g., using gaming RNG 318 and/or one or more lookup tables 322A-322N) to ensure that the actual award exceeds the credit threshold value. Still further, in certain embodiments, the respin process can engage one or more, but not all, of the reels to achieve the credit threshold value based on a respin criterion (e.g., whether the initial reelspin for a selected reel produced a symbol with an associated award). And, in some embodiments, when a respin is triggered, the underlying reel strip can be modified (e.g., to provide enhanced awards and/or increased probabilities that the respun reel will achieve a reel-strip symbol with an associated award). The credit threshold value can be dynamically set for each activation of the sub-feature; in other words, the threshold value can vary each time a player enters the sub-feature.

IV. Example Multi-Level Feature Embodiments

IV.A. Introduction

This section describes various innovations in multi-level mechanisms for selecting one of a plurality of gaming sub-features and, in some implementations, further selecting outcomes of that gaming sub-feature.

IV.B. Example Multi-Level Feature Embodiments

In this subsection, example embodiments are presented that illustrate features of the disclosed multi-level feature technology. Although the illustrated embodiments are shown as being part of a particular game (here, a "Mad Max" themed game), it is to be understood that this is by way of example only and that the disclosed display techniques can be updated to any underlying game with different thematic elements.

Figure 4:
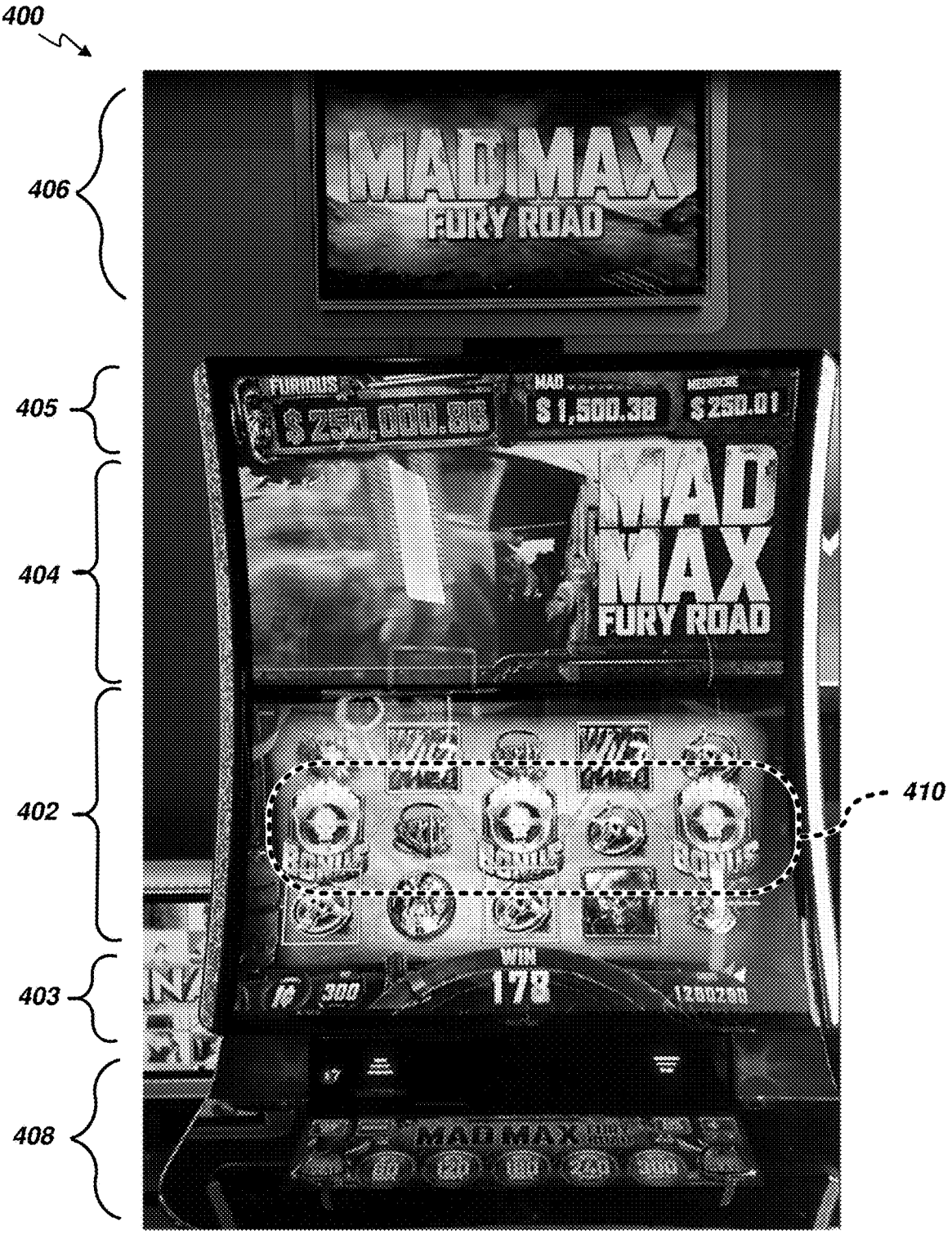
FIGS. 4-9(A-G) are example screen shots showing aspects of the disclosed technology.

FIG. 4 shows an example screen shot 400 of a display screen of an EGM for a reel game (e.g., a base reel game). The example screen shot 400 may be rendered on a main display screen, secondary display screen, or other display screen of an EGM.

The example screen shot 400 shows a reel area 402 of a primary game display (e.g., primary game display 240), a supplemental information area 403 of the primary game display, a secondary game display area 404 of a secondary game display (e.g., secondary game display 242), a progressive display area 405 of the secondary game display, a topper display area 406, and button deck area 408 (e.g., representing the buttons on the button deck 120 that the player can actuate during game play).

The reel area 402 shows viewable portions of five reels. For each of the five reels, the viewable portion of the reel encloses three positions of symbols that span the reel area. The supplemental information area 403 presents information such as a denomination, current bet amount, a current bet level (e.g., ×1, ×2, ×3, ×4, ×5), a count of pay lines that are monitored, an amount of credits remaining, and/or a win amount for a round of play. The button deck area 408 shows an example set of buttons for selecting a wager option available to the player. In the illustrated embodiment, the button deck area includes five betting options from a baseline bet of 60 credits, including ×1, ×2, ×3, ×4, ×5 betting options, as well as two "play" buttons (shown at the far left and far right of the button deck area 408) to initiate a game based on the selected bet.

The example screen shot 400 also shows three progressive jackpot areas in the progressive display area 405. In particular, the progressive display area 405 includes a first progressive jackpot (here, labeled "FURIOUS") for the highest jackpot level, a second progressive jackpot (here, labeled "MAD") for the middle jackpot level, and a third progressive jackpot (here, labeled "MEDIOCRE") for the lowest jackpot level.

In FIG. 4, the reel area 402 of the example screen shot 400 shows a triggering event for launching a game feature in accordance with embodiments of the disclosed technology. In the illustrated embodiment, the trigger is a symbol-driven trigger, but can also be a random non-symbol-driven trigger. More specifically, in the particular non-limiting embodiment illustrated, the trigger is the occurrence of a bonus symbol on the first, third, and fifth reels, though any other symbol trigger is possible. In further embodiments, the trigger can be a random trigger that is not an outcome of the reel symbols, but is instead determined randomly regardless of the outcome of the reel symbols.

Figure 5:
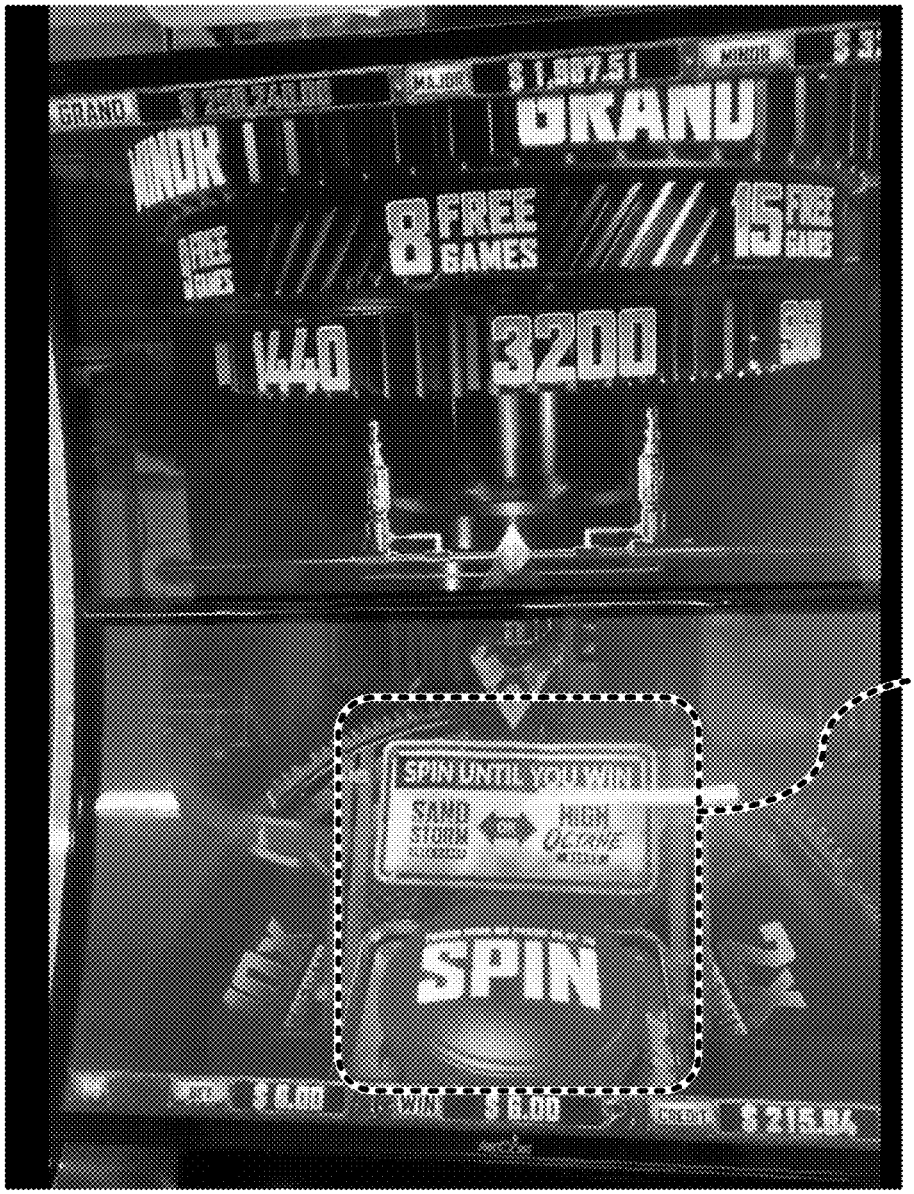

FIG. 5 shows a further example screen shot 500 of the display screen of FIG. 4 in a further state following the triggering of the game feature in accordance with embodiments of the disclosed technology. In this example screen shot 500, a screen area 510 explains the basic game mechanic of the game feature. In particular, the example screen area 510 states: "SPIN UNTIL YOU WIN [A FREE SPINS SUB-FEATURE]" and the example spin button states: "TOUCH HERE OR PRESS PLAY TO SPIN."

In the example embodiment, two bonus sub-features are available entitled "sand storm" and "high octane", which are thematically relevant to the theme of the underlying base game, but can of course vary from implementation to implementation. Further, the basic game mechanic of spinning until a "free spins" sub-feature can vary from implementation to implementation. For example, the winning of a different available sub-feature can be the terminating event for the multi-level game feature (e.g., a progressive awarding feature, a multiplier feature, or any other game feature). Still further, the terminating event can be the accomplishment of a certain credit threshold or outcome from a sub-feature (e.g., a certain number of "free spins" of the base game can be awarded that reaches a terminating credit threshold, a number of spins of the "primary wheel" can be awarded that, once performed, terminates the multi-level feature, or other event). Still further, in some embodiments, once the primary wheel is initiated for a first time (or any other n time, where n is greater than 1), the primary wheel (and underlying random-selection mechanism) can include an outcome that terminates the multi-level feature (e.g., a "collect" or similar primary-wheel slice, which can indicate the outcome of an underlying random-selection mechanic as discussed.)

Figure 6A:
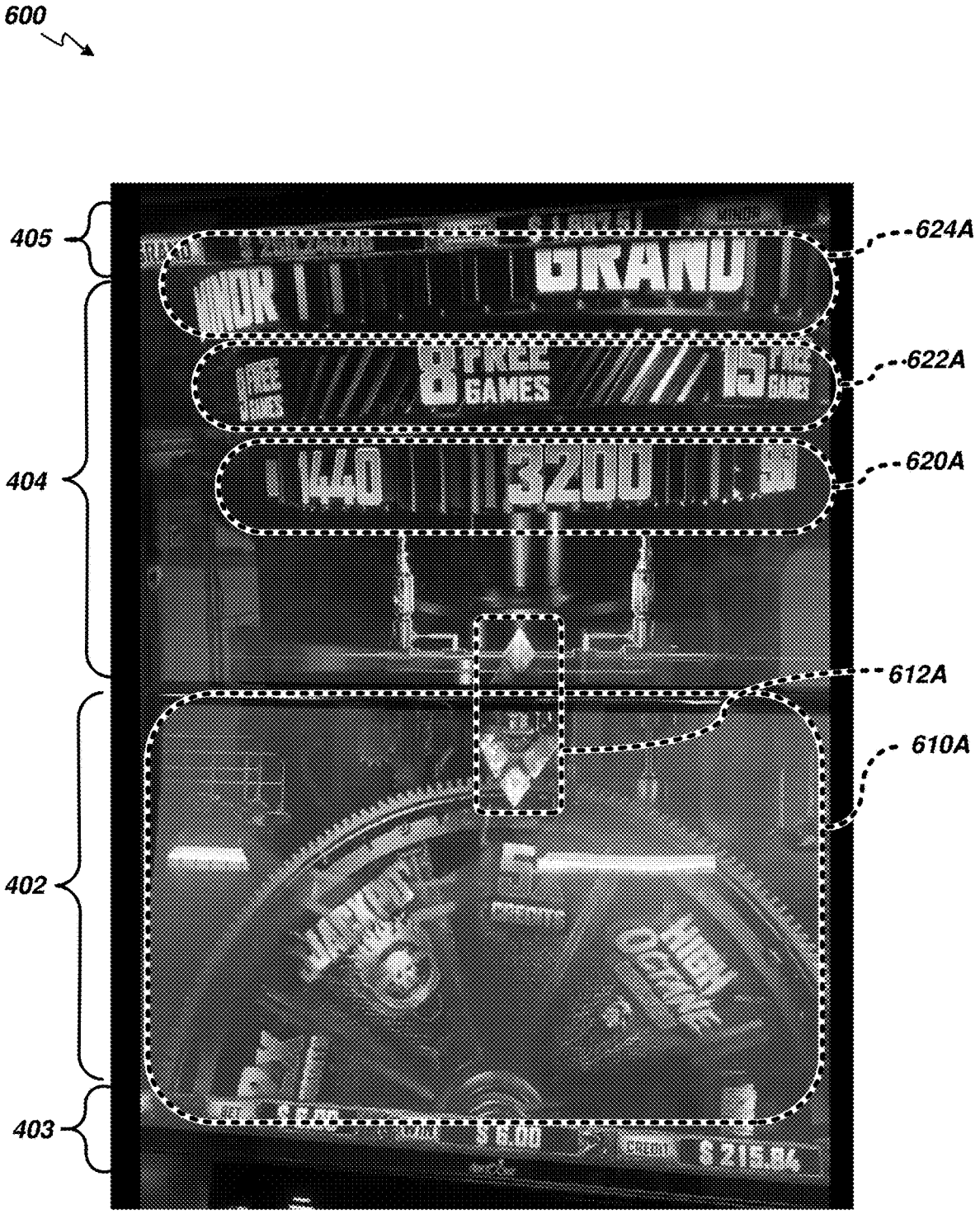

FIG. 6A shows a further example screen shot 600 of the display screen of FIG. 4 in a further state following a triggering of the user selecting the "spin" portion of screen area 510 or pressing "play" on the triggering of the game feature in accordance with embodiments of the disclosed technology. In this example screen shot 600, the primary elements of the multi-level game feature are displayed. In particular, the example screen shot 600 displays a primary wheel 610A (shown here in a top down-view displayed in the reel area 402). The primary wheel 610A is a virtual wheel where each "pie piece" of the wheel identifies a particular sub-feature or award. For example, in the illustrated screen shot 600, the primary wheel 610A includes a "2× credits" award, and a "5× credits" award, as well as a reel-spin sub-feature (e.g., in this example, the "high octane" sub-feature) and a "jackpot" award. Although not shown in the display 600, the primary wheel 610A also includes pie pieces for a further reel-spin sub-feature (e.g., in this example labelled the "sand storm" feature) and one or more credit-awarding sub-features (e.g., labelled as "credits" with a credit multiplier associated with the pie piece). For the purpose of this disclosure, the reel-spin sub-features can also be referenced throughout this disclosure as bonus sub-features.

In general, the primary wheel 610A visually represents an underlying random-selection mechanism for choosing one of the available sub-features or awards that are identified on the primary wheel. Further, it should be understood that the underlying random-selection mechanism can be performed using a random number generator which can select one of the available outcomes (e.g., using a lookup table that, for example, includes weights to makes certain outcomes more or less likely to occur according to the game designer's preferences). Also shown in FIG. 6A is a pointer element 612A that is used to identify to the user the outcome of the underlying random-selection mechanism for the primary wheel 610A by pointing (e.g., by a downward-facing pointer portion) to the pie piece (and thus the award or sub-feature) that is selected.

FIG. 6A also shows three secondary wheel displays 620A, 622A, 624A (shown here in a front view), each associated with a different respective sub-feature or award. Further, each of the secondary wheel displays 620A, 622A, 624A also includes respective pie pieces for two or more different outcomes for its associated sub-feature or award. In more detail, the secondary wheel 620A is associated with a credit-awarding sub-feature and includes several possible outcomes of different credit awarding amounts; the secondary wheel 622A is associated with a free games (or free spins) sub-feature and includes several possible outcomes of different numbers of free games (spins) to be awarded; and the secondary wheel 624A is associated with a progressive-jackpot-awarding sub-feature and includes several possible outcomes of different jackpot pools to be awarded. As with the primary wheel 610A, each of the secondary wheel displays 620A, 622A, 624A visually represents an underlying random-selection mechanism for choosing one of the available outcomes for a sub-feature or award that has been selected and triggered by the primary wheel. As above, it should be understood that the underlying random-selection mechanism can be performed using a random number generator which can select one of the available outcomes (e.g., using a lookup table that, for example, uses weights to makes certain outcomes more or less likely to occur according to the game designer's preferences).

Figure 6B:
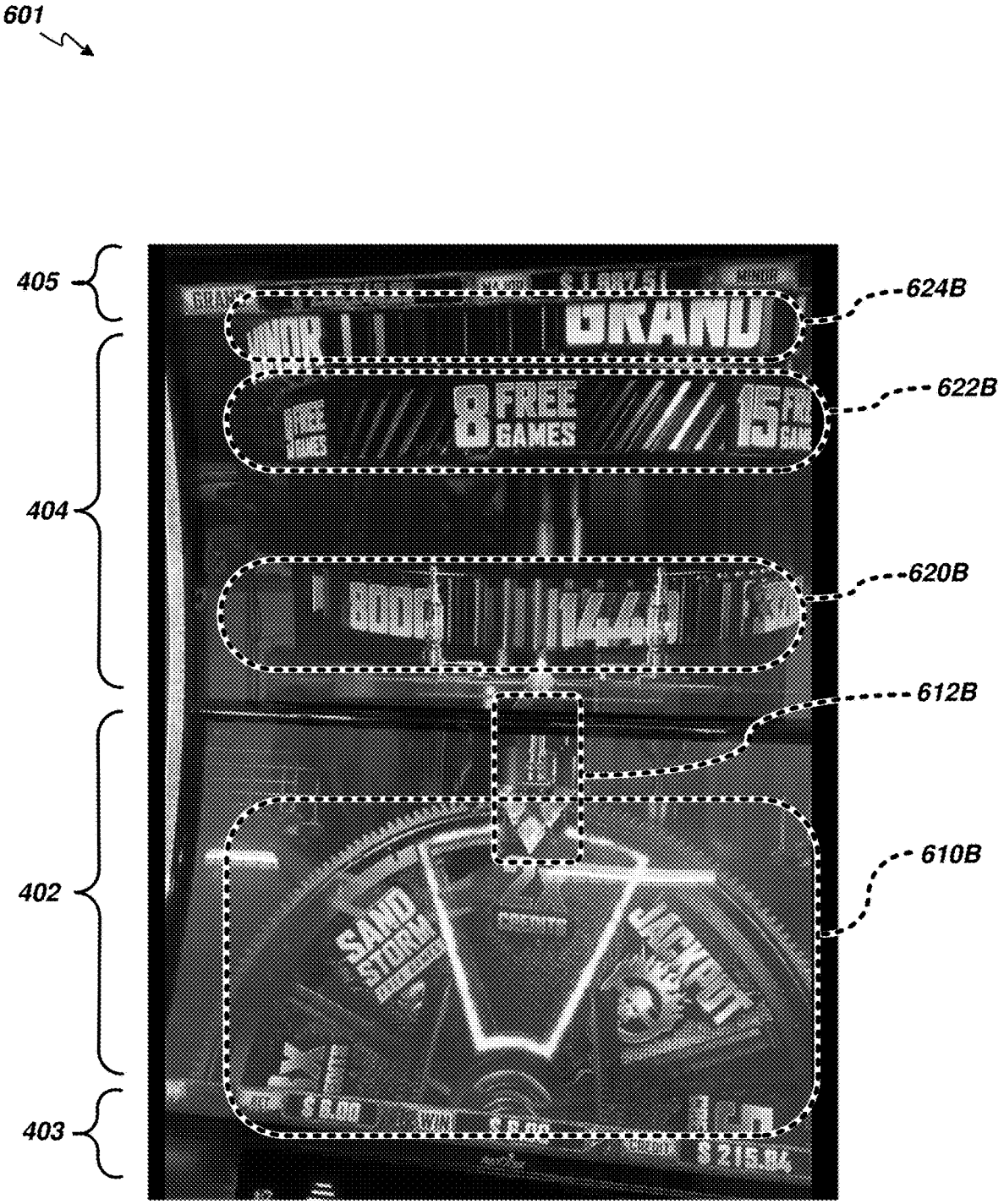

FIG. 6B shows a further example screen shot 601 of the display screen of FIG. 6A in a further state showing a primary wheel display 610B after the primary wheel display has slowed and the pointer 612B has identified the randomly selected sub-feature. In the illustrated embodiment, the selected sub-feature is the 2X credits feature, which causes the display of the secondary wheel 620B to move in a visually apparent manner (e.g., dropping toward the pointer 612B) that indicates the selection of the credit multiplying sub-feature (here, a 2X credit multiplying feature) relative to the secondary wheels 622B and 622B. A sub-feature random selection process is then implemented that selects a number of credits from the secondary wheel 620B, the result of which will then be multiplied by the selected amount from the primary wheel. The sub-feature random selection process can be performed by an RNG (e.g., with a weighted or non-weighted table) to select an amount that is presented via the secondary wheel 620B.

Figure 6C:
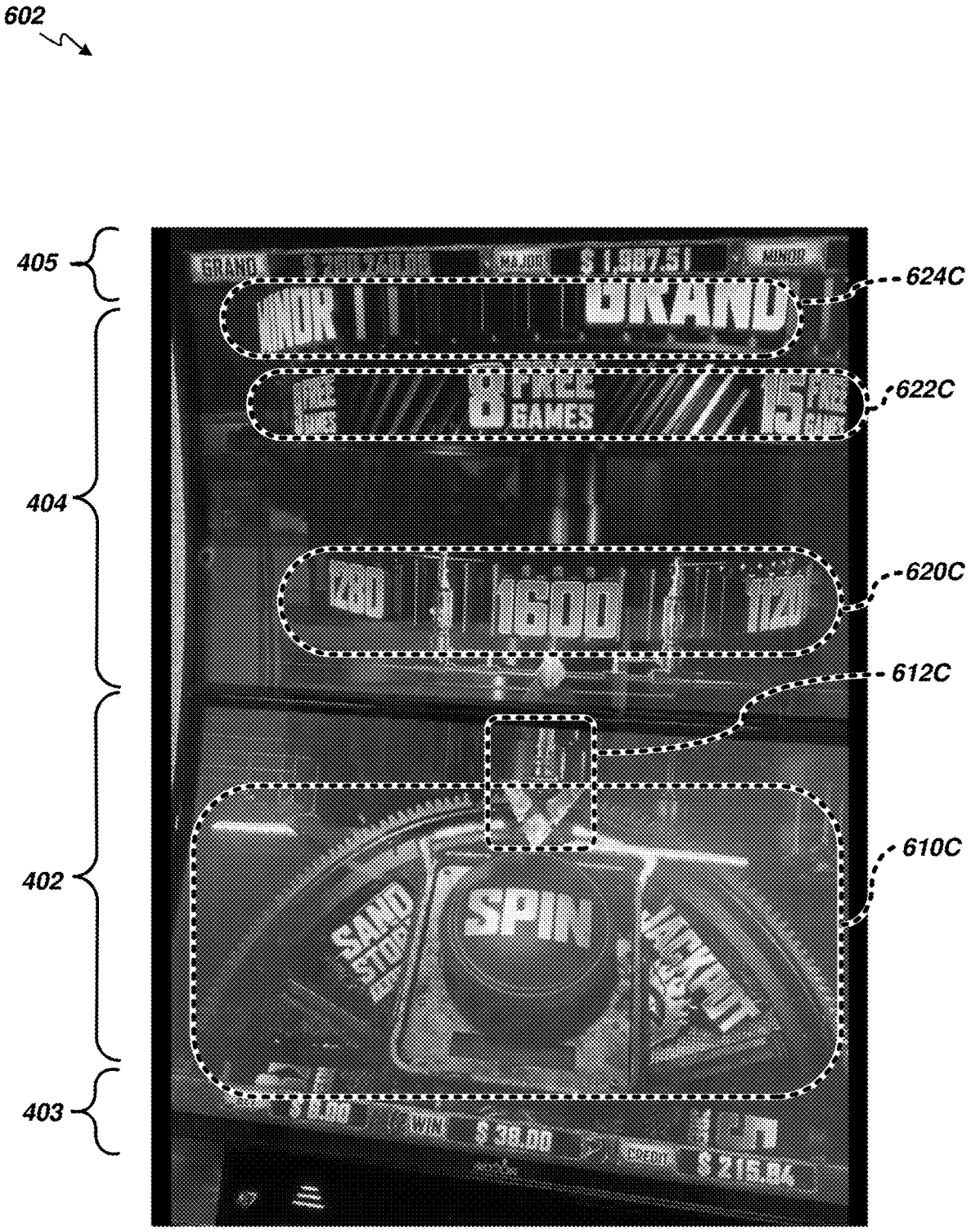

FIG. 6C shows a further example screen shot 602 of the display screen of FIG. 6B in a further state showing a result of the selected sub-feature on secondary wheel 620C (in this example, 1600 credits), which, in this example, will be multiplied by 2 as explained above with respect to FIG. 6B. Further, in the illustrated screen shot 602, because a terminating event has not occurred (e.g., as explained above), the display presents a user with a further indicator in screen area 610C (e.g., a button marked "spin") to re-spin the primary wheel.

In certain embodiments, and as noted, the primary wheel can be repeatedly used to select a sub-feature or award until a terminating event is reached. For example, as noted above, the terminating event may be the award of a "free spins" sub-feature, but can be any other outcome from the primary wheel. In other words, once the multi-level feature of the disclosed technology is triggered, the primary wheel is used to select a sub-feature or award. The selected sub-feature or award will then be performed or awarded, after which the multi-level feature will return to a further "spin" of the primary wheel to select a further sub-feature or award until a terminating event is reached. As noted, the terminating event can be the selection of one or more particular sub-features or awards from the primary wheel (e.g., any one or more of a "free spins" sub-feature, etc.).

Figure 6D:
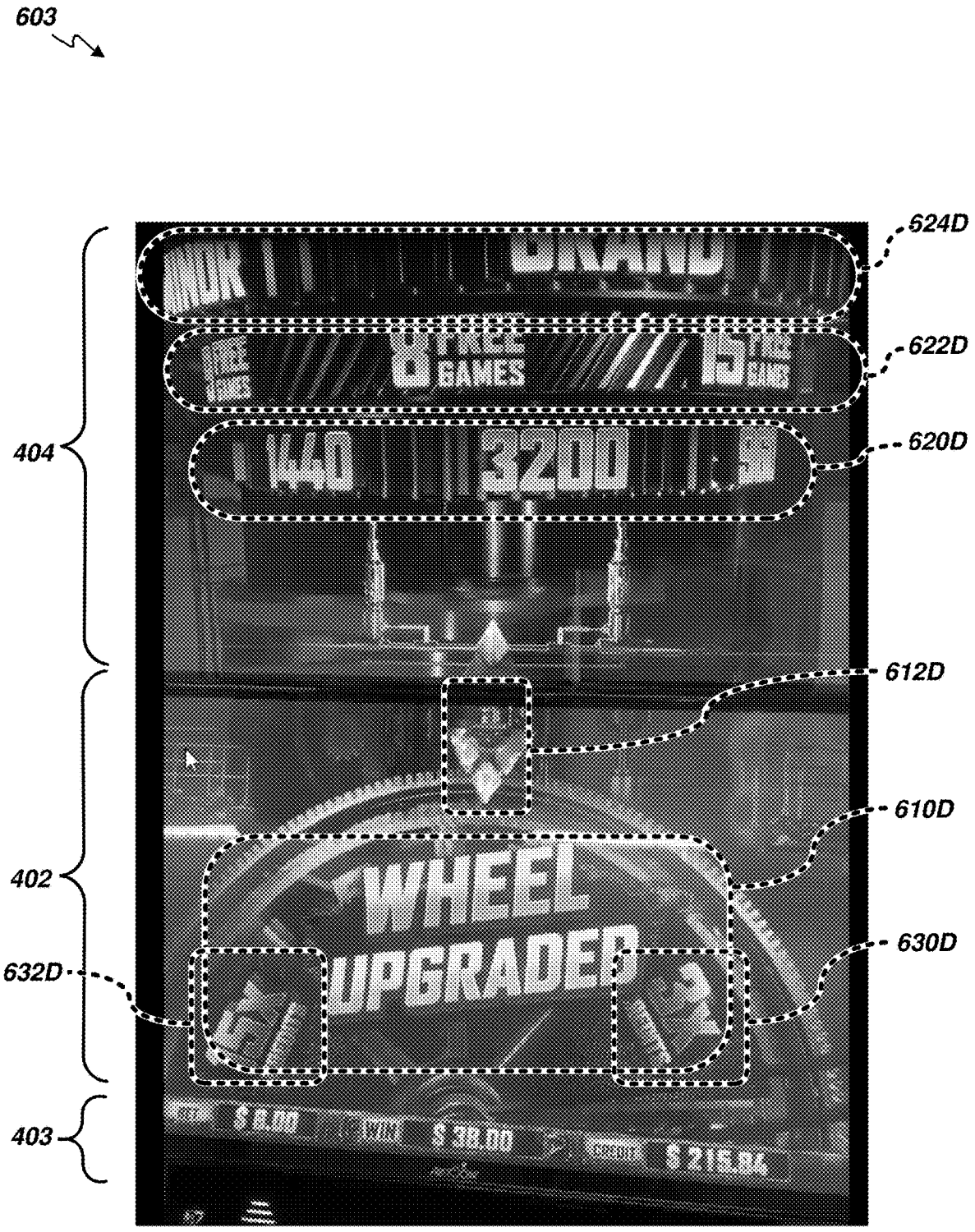

FIG. 6D shows a further embodiment wherein the sub-features offered by the primary wheel are altered (e.g., upgraded) after a player triggers a non-terminating sub-feature. In the illustrated example, for instance, one or more of the credit awarding sub-features are altered to include higher multipliers than in the initial primary wheel. Other sub-features can be altered as well, and further (or additional) sub-features can be added to the primary wheel. Still further, the odds of obtaining a particular sub-feature can be altered after an initial sub-feature is selected. This "wheel upgrade" process can include 1 to n upgrades after a non-terminating sub-feature is triggered (actuated), depending on the design of the game. For example, there may be only 2, 3, 4, or 5 wheel upgrades. It should be understood, however, that the number of wheel upgrades is not limited, as any integer number of wheel upgrades is possible with any one or more of the sub-feature alterations described above. It should also be understood that the achievement of a non-terminating sub-feature can alter the available sub-features in other ways as well (e.g., decreasing the value of one or more sub-features or eliminating one or more sub-features altogether).

In other words, and in some embodiments, when a non-terminating event is selected in the first-level of the multi-level feature (e.g., and as indicated by the primary wheel) and after the selected sub-feature or award are performed, the multi-level feature performs a further "spin" of the primary wheel to select a further sub-feature or award. Additionally, and in some embodiments, for one or more further instances where the multi-level feature returns to the primary wheel for a further selection (which, as explained, is performed by an underlying random-selection mechanism), one or more upgrades can be made available to the user. For instance, and as shown in areas 630D and 632D of screen shot 603 of FIG. 6D, an available sub-feature of the primary wheel may be upgraded with a multiplier value indicating that if that sub-feature is selected, its return will be multiplied. It should be understood that any one or more of the available sub-features or awards from the primary wheel can be upgraded upon one or more consecutive spins, as outlined above.

Figure 7A:
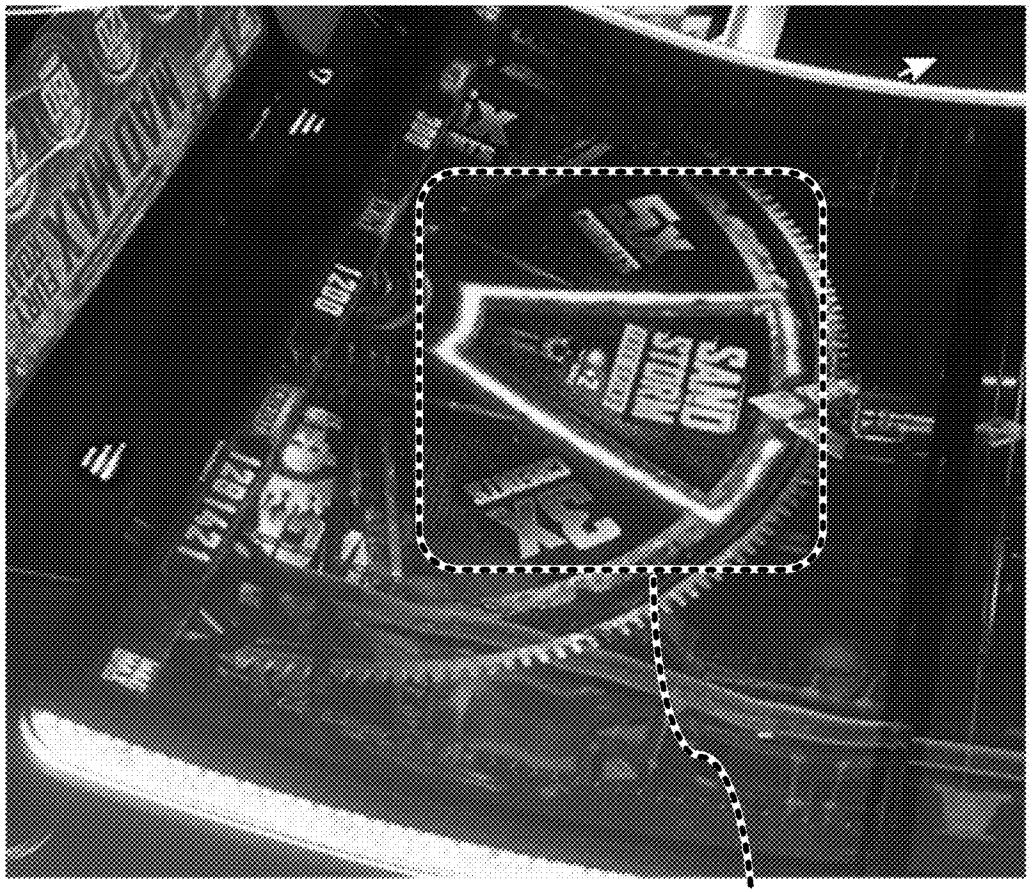

FIG. 7A shows a further example screen shot 700 of the display screen of FIG. 6A in a further state showing a primary wheel display area 711 indicating the outcome of the random selection process underlying the primary wheel.

In this example, the primary wheel has stopped and the pointer identifies the selected award or sub-feature. In this instance, the selected sub-feature is a free spins sub-feature (here, and by way of example, the "sand storm" sub-feature).

Figure 7B:
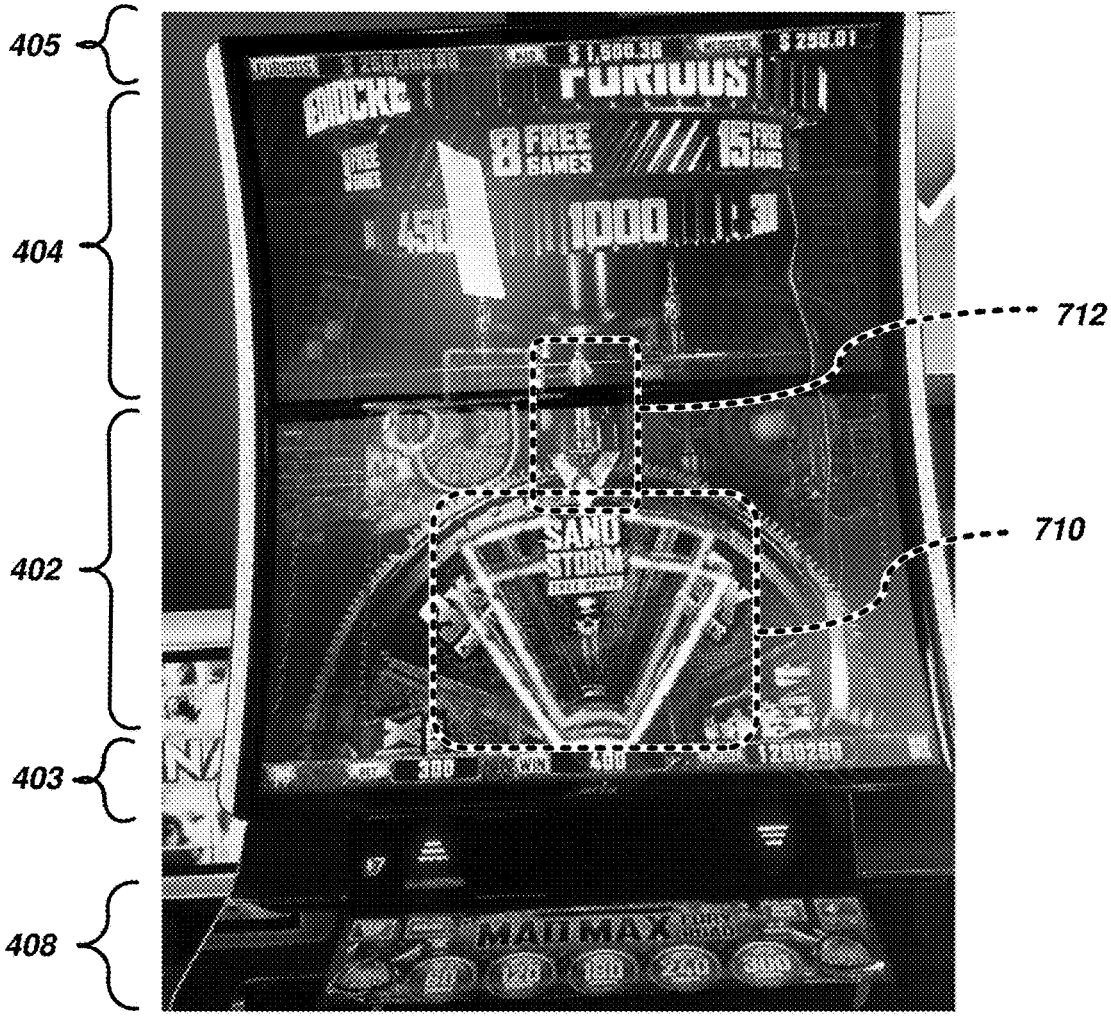

In this example implementation, and as shown in FIG. 7B, the selection of the sub-feature begins one of multiple animation sequences in which the relevant secondary wheel moves into a location whereby the pointer 712 also includes an upward-facing point that will be used to display the result from the random-selection procedure for the secondary wheel, where the secondary wheel is the selected sub-feature or award from the primary wheel (e.g., one of secondary wheels displayed in 7B).

Figure 7C:
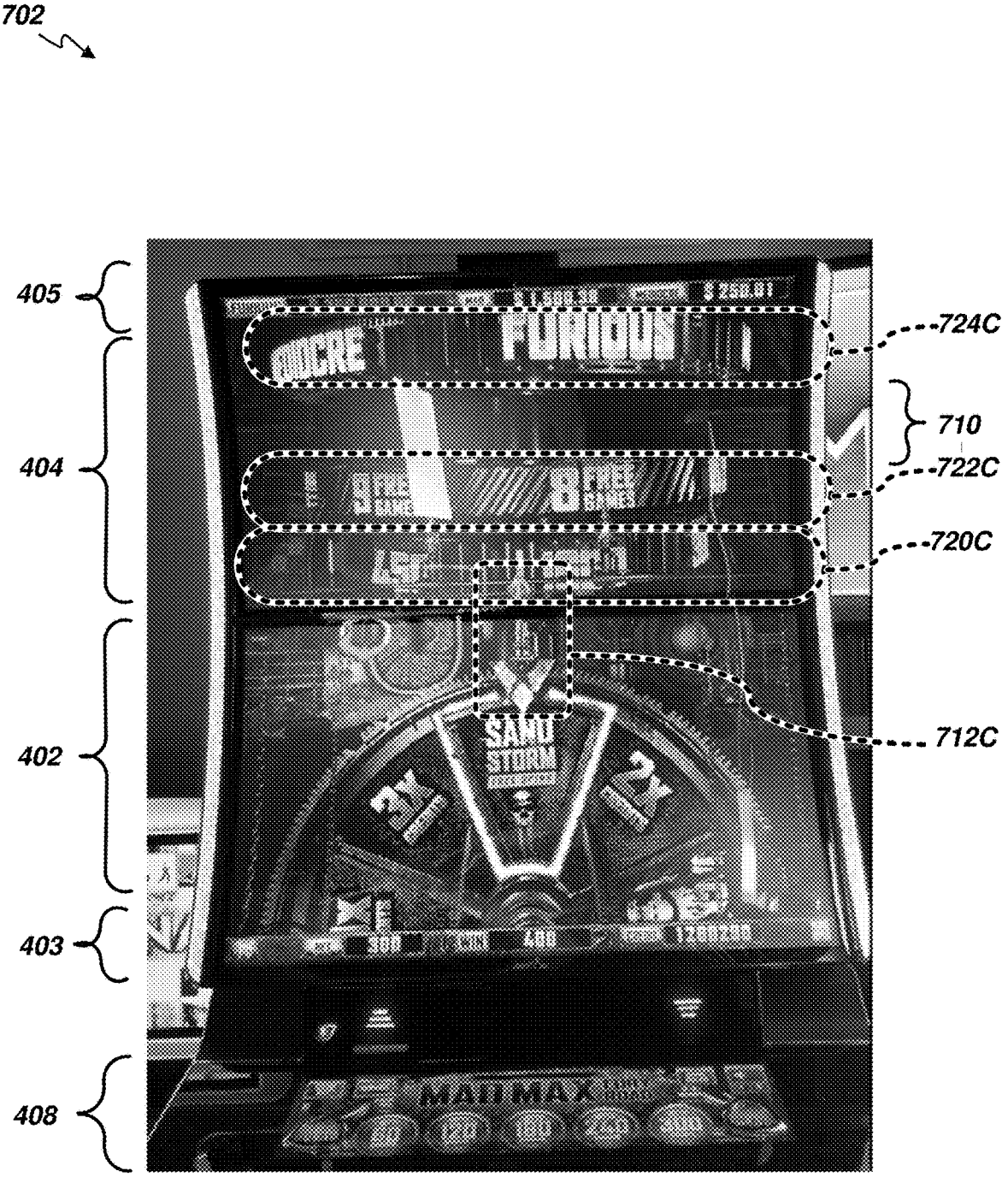

In this example implementations, and as shown in FIG. 7C, example screen shot 702 shows a further example screen shot 702 of the display screen 610A in a state in the middle of an animation sequence where one of the secondary wheels is moving into a place adjacent to the upward-facing point of the pointer 712C. In this particular nonlimiting example, secondary wheels 720C and 722C "drop" toward the pointer 712C. This movement is represented in FIG. 7C by gap 710, which shows the secondary wheels 720C, 722C as they move into place for the second-level of the multi-level feature. Further, because the sub-feature selected by the primary wheel is the free spins sub-feature, the "dropping" animation will continue until the secondary wheel 722C (corresponding to the free spins sub-feature) is adjacent to the upward-facing point of pointer 712C. Secondary wheel 720C will then disappear from the display, as it was located under the selected secondary wheel 722C.

Figure 7D:
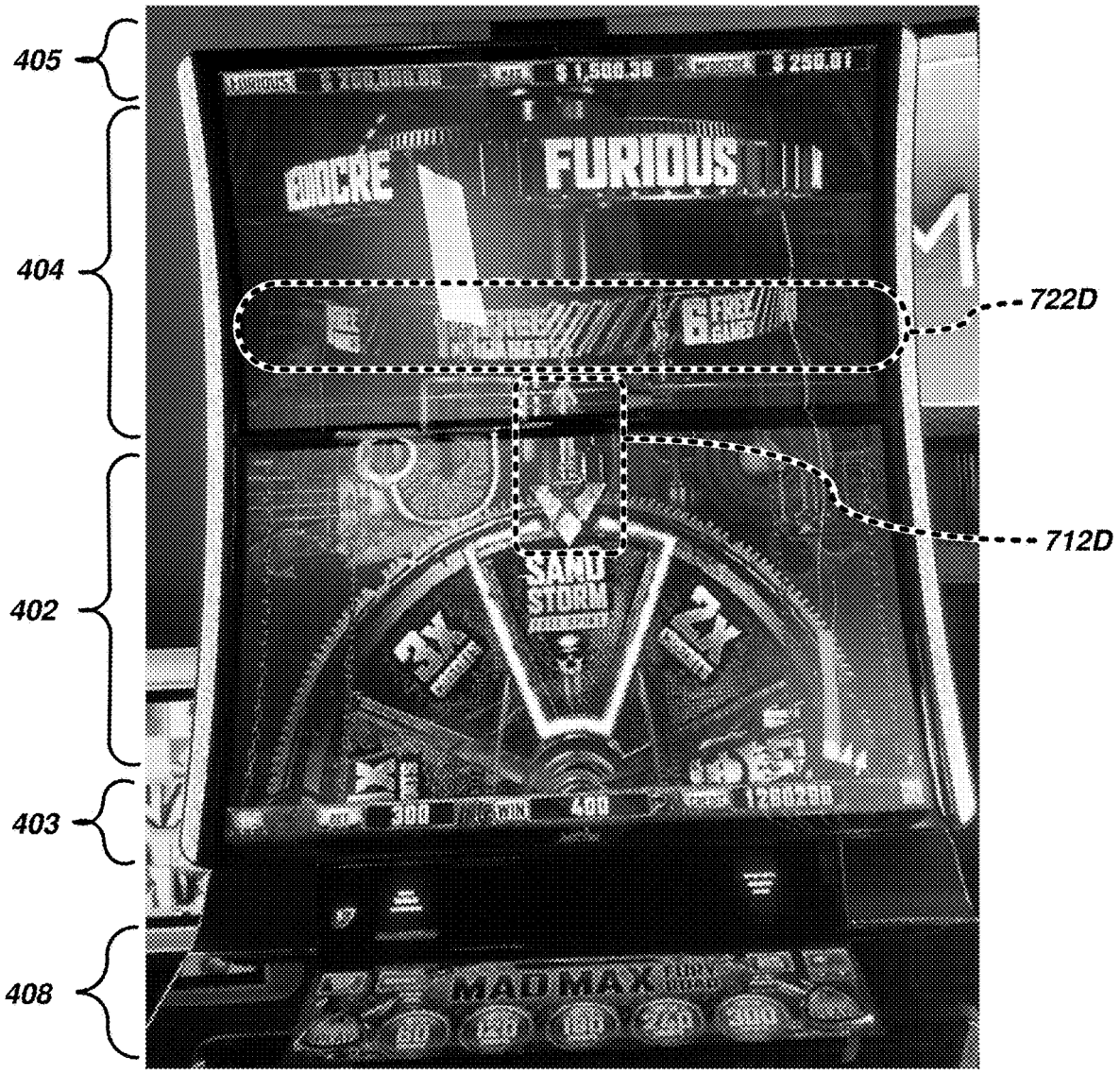

FIG. 7D shows a further example screen shot 703 of the display screen of FIG. 7C in a further state of an animation sequence where the selected one of the secondary wheels (722D) is moved into a position adjacent to the pointer 712D and has begun to display a spinning motion to reveal the outcome of the underlying random-selection procedure for selecting the outcome of the secondary wheel (as explained above).

Figure 7E:
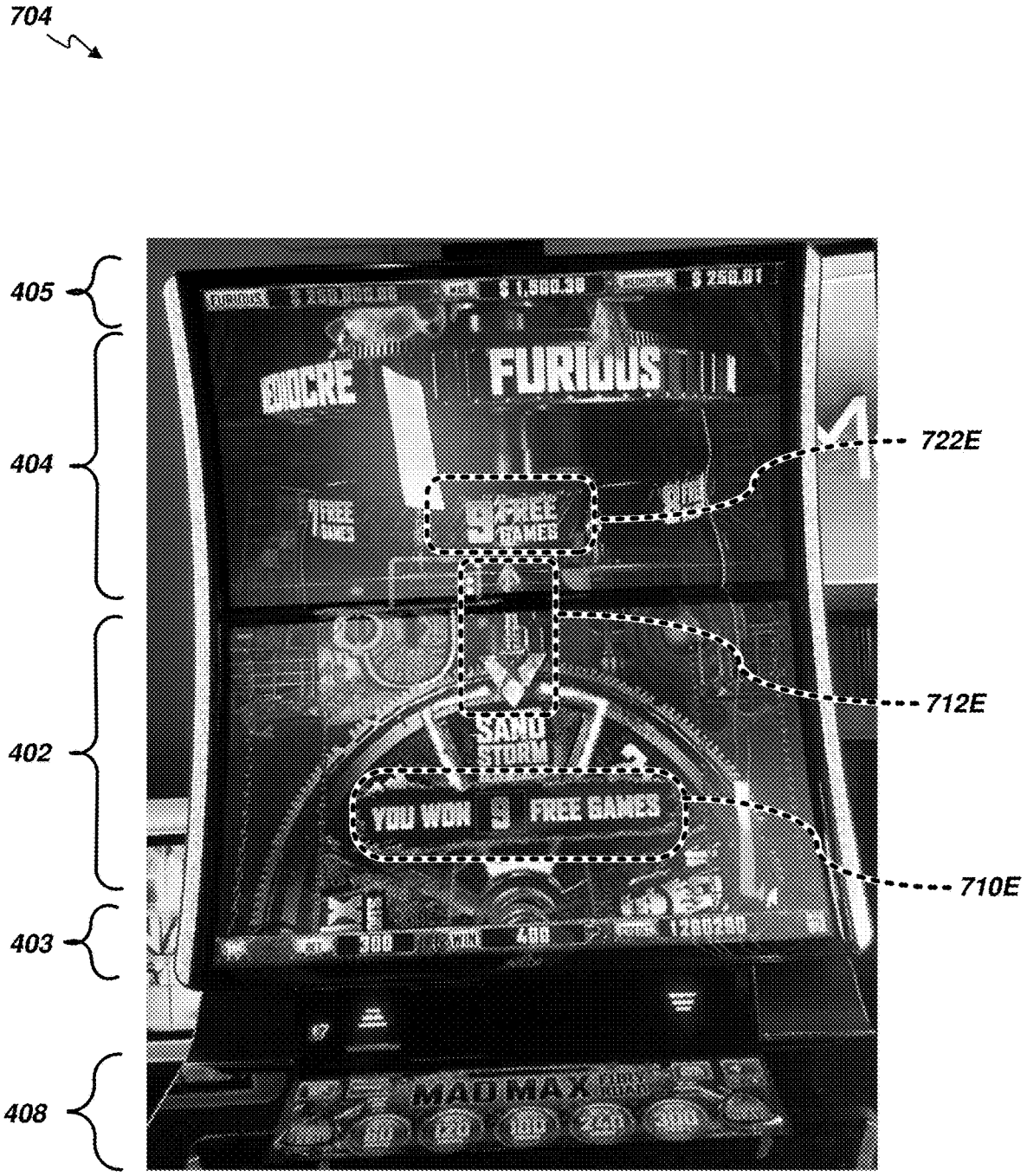

FIG. 7E shows a further example screen shot 704 of the display screen of FIG. 7D in a further state revealing the outcome of the underlying random-selection procedure for the selected one of the wheels (here, the secondary wheel 722E for the free spins sub-feature). As can be seen in this example, the outcome revealed in this instance is shown in display portion 710E and shows the outcome of "9 free games" (or "9 free spins"). Further, in this example, a further award-outcome area 1010 is shown stating: "YOU WON 9 FREE GAMES".

Figure 8:
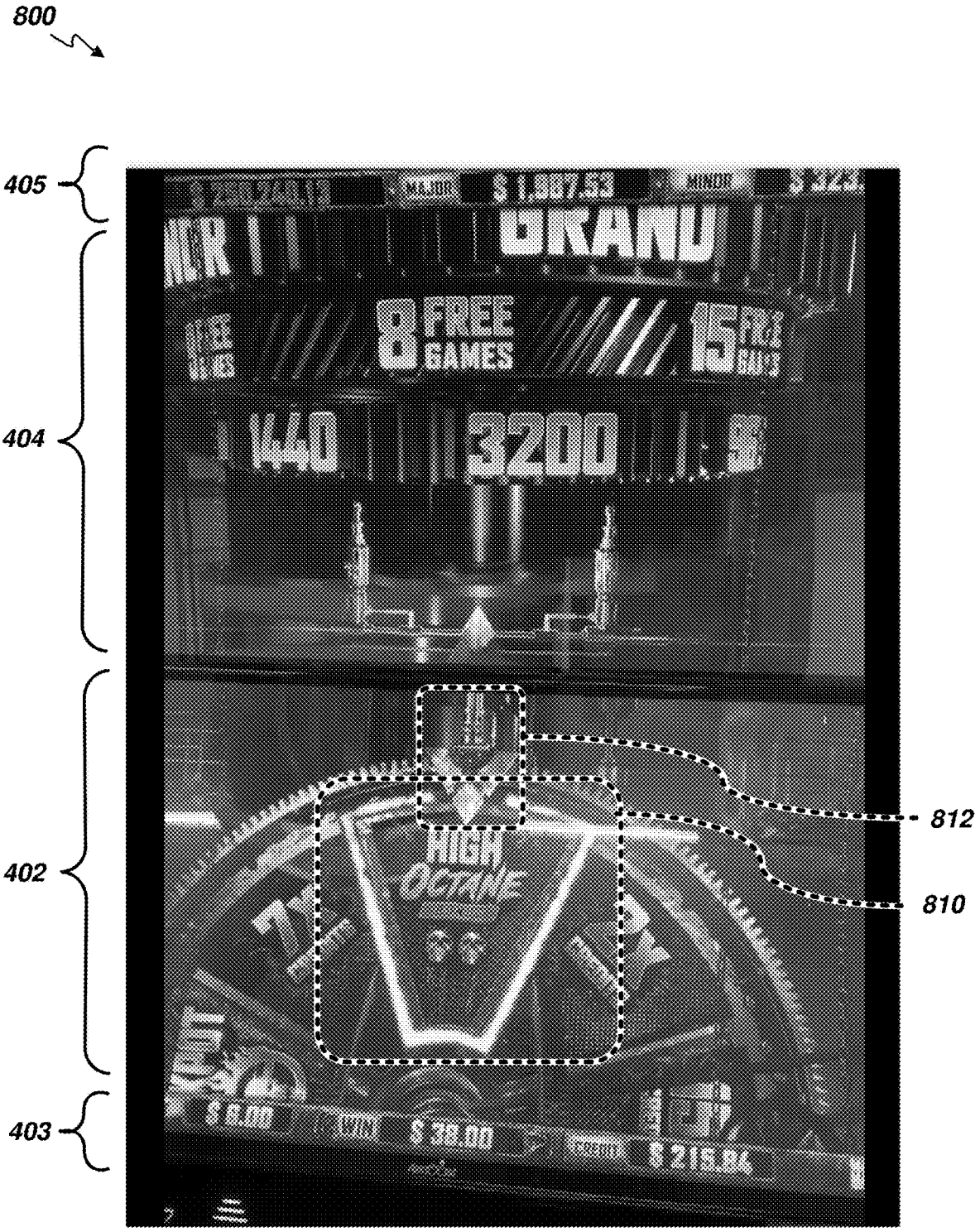

FIG. 8 shows a further example screen shot 800 of the display screen of FIG. 6A in a further state showing a primary wheel display area 810 and pointer 812 indicating the outcome of the random selection process underlying the primary wheel. In this example, the primary wheel has stopped and the pointer identifies the selected award or sub-feature. In this instance, the selected sub-feature is a spinning wheel sub-feature with enhanced awards (here, and by way of example, the "high octane" sub-feature).

Figure 9A:
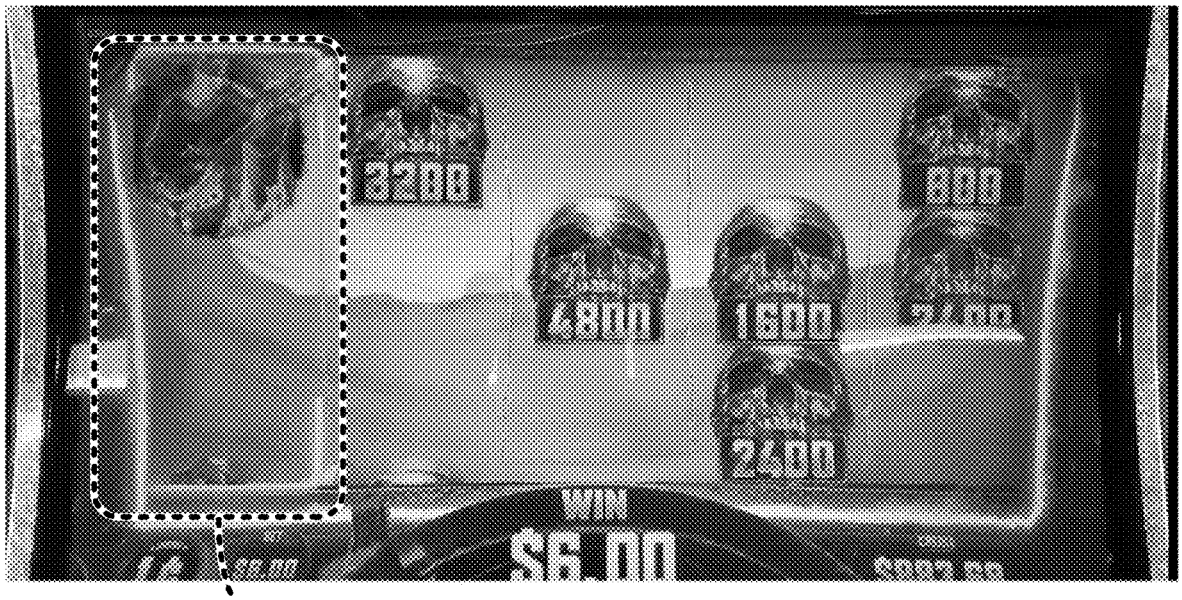
Figure 9B:
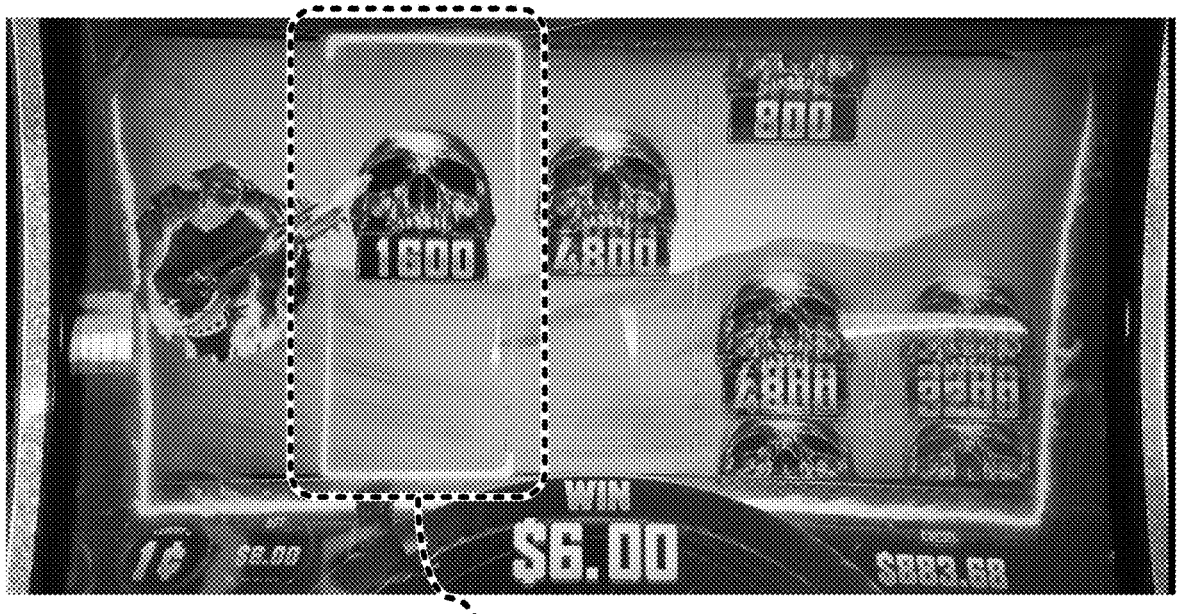
Figure 9C:
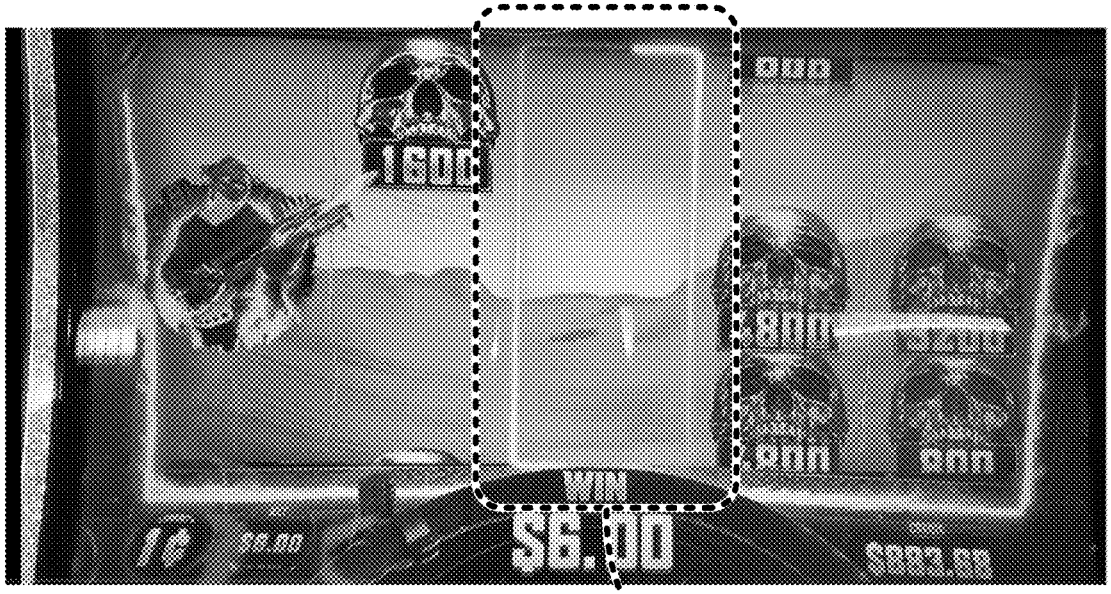
Figure 9D:
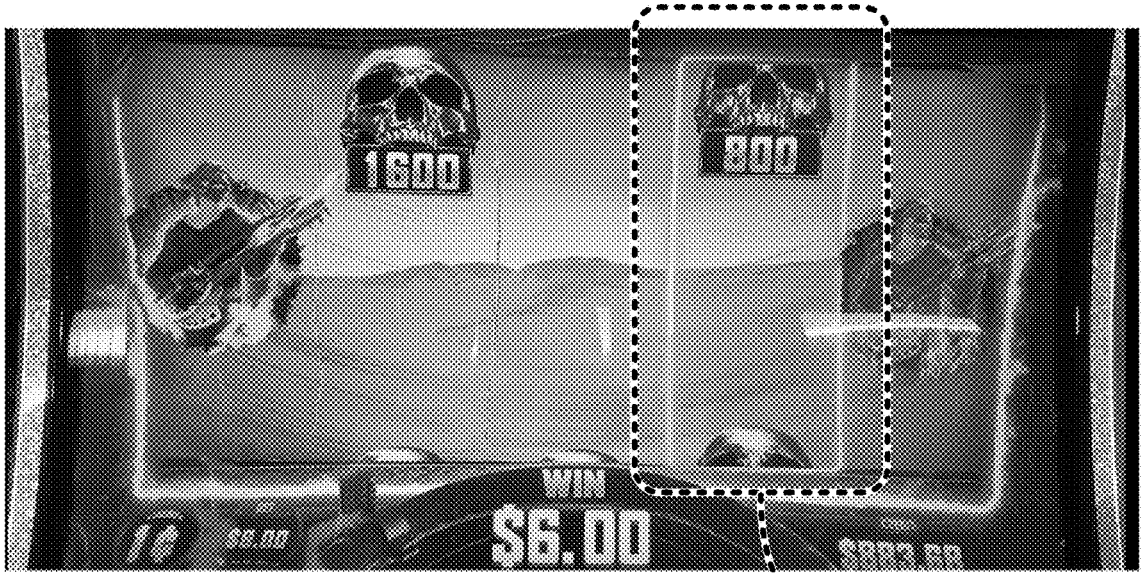
Figure 9E:
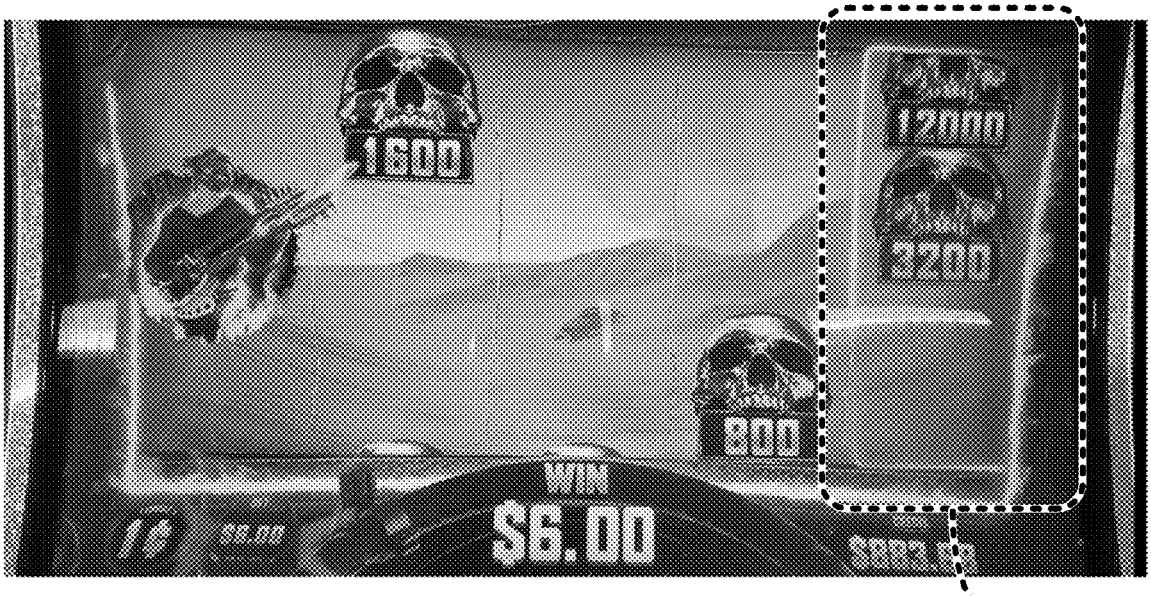

FIG. 9A shows a first screen shot 900 of the selected sub-feature from FIG. 8. In particular, first screen shot 900 shows a reel-game sub-feature (here, a five column by three row reel game). In this particular embodiment, the reel-game sub-feature includes a first reel (shown at 910) that includes a theme-specific reel symbol. In certain embodiments, the first reel is weighted so that the theme-specific reel symbol is guaranteed to appear on the first reel. In other embodiments, the first reel does not contain a theme-specific reel symbol and/or is not guaranteed to appear.

Figure 9F:
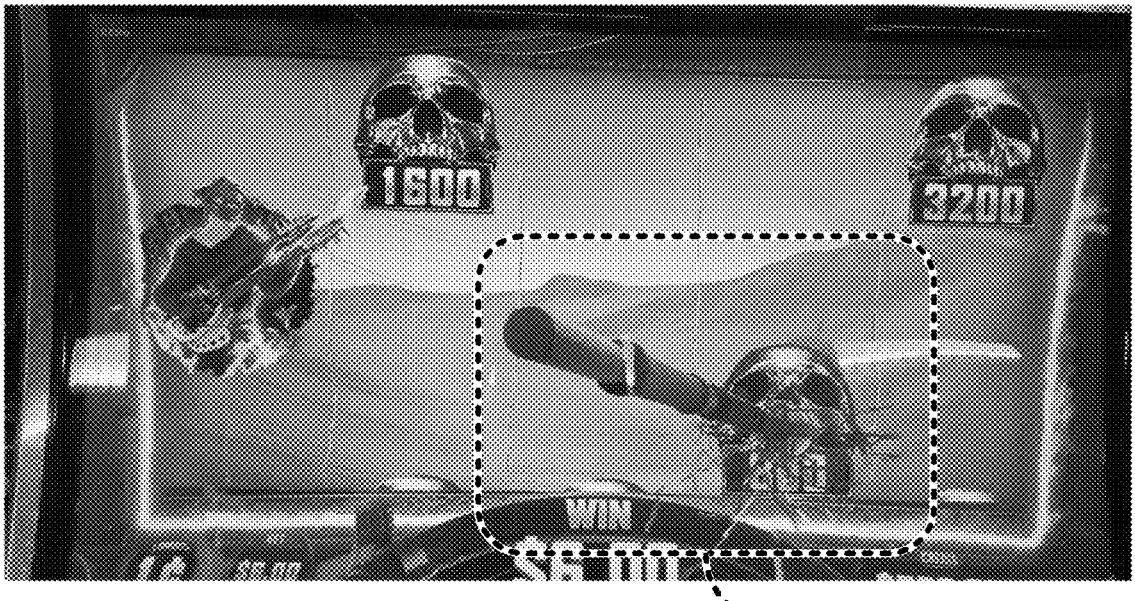
Figure 9G:
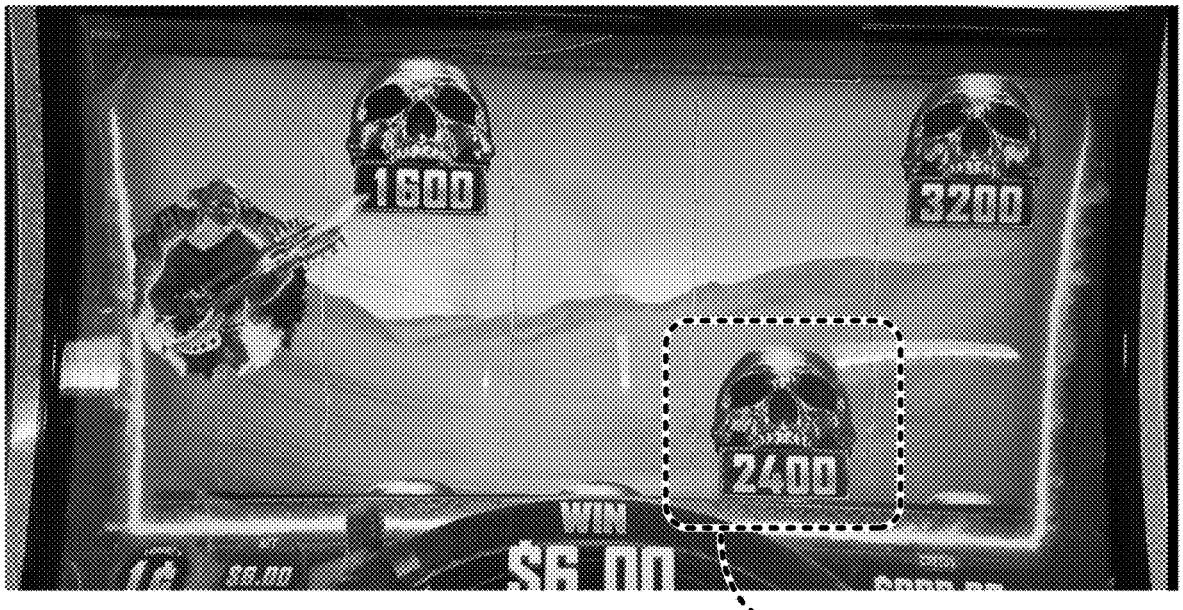
Figure 10:
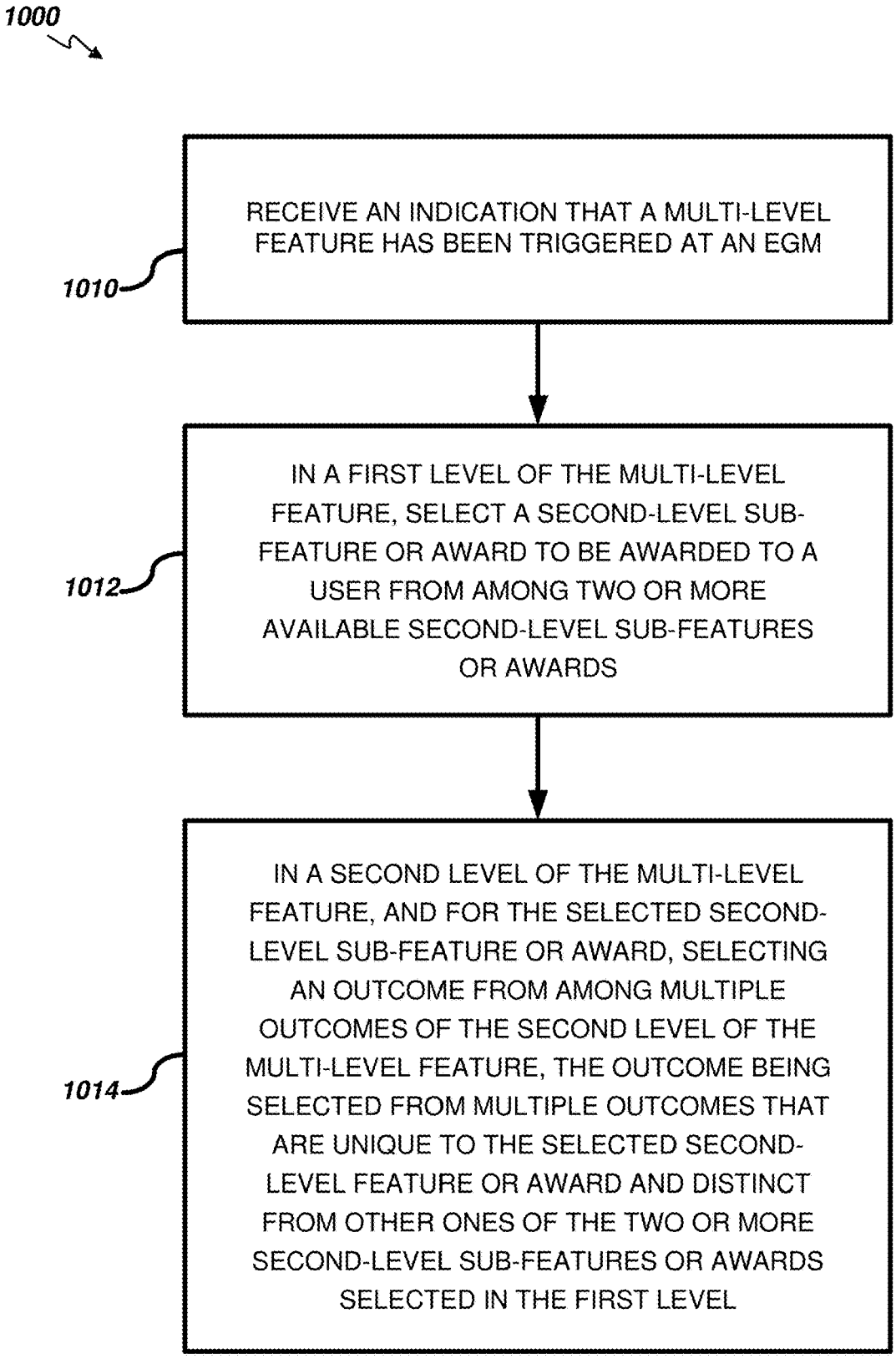

As shown in FIGS. 9B-9E, the second reel (920 in FIG. 9B), the third reel (930 in FIG. 9C), the fourth reel (940 in FIG. 9D), and the fifth reel (950 in FIG. 9E) are shown being highlighted as they spin and lock into place. In certain embodiments, the credit values that appear in the symbols from reels two through five are awarded to the player. Further, in some embodiments, a further random multiplier is applied to one or more of the selected reel symbols. In particular embodiments, a single reel symbol is randomly selected and a randomly selected multiplier is applied to the associated credit value. For example, as shown at 960 in FIG. 9F, the reel symbol from the fourth symbol is selected and an animation is displayed showing selection of that reel symbol. In FIG. 9F, and by way of example, the selected reel symbol is associated with a credit value of 800. FIG. 9G shows a screen shot 907 after application of the selected multiplier. In this particular example, the multiplier was a "3×" multiplier applied to the reel symbol shown at reel symbol 970, thereby resulting in a credit award of 2400 credits.

In certain example embodiments, the number of credit-awarding reel symbols and/or the values of the credit-awarding reel symbols varies depending on the state of the underlying primary reel (such as primary wheel 610A or upgraded primary wheel 610D). For example, the number of credit-awarding reel symbols can be increased as the underlying primary wheel advances in state and/or the credit awards can be increased as the underlying primary wheel advances in state.

In further embodiments, the reel-game feature (e.g., as shown in FIG. 9A through FIG. 9G) is configured to continue until a randomly selected credit threshold is satisfied (e.g., until the credit threshold is met or exceeded by a spin within the reel-game sub-feature). The credit threshold can be randomly selected (e.g., using RNG 318 and/or one or more lookup tables 322A-322N) from within any desired credit range. In particular embodiments, the credit threshold can be selected randomly each time the reel-game feature is selected. Furthermore, the credit ranges can be modified (increased or decreased as desired by the game designer) depending on the state of the underlying primary reel. Still further, the credit threshold (and the range from which it is selected) can be used to achieve a desired level of randomness in the game.

In particular embodiments, the random multiplier (described above with respect to FIG. 9F) is continuously applied to the reel symbols until the threshold is met or exceeded. In other words, the reel-game sub-feature only includes a single spin, but the random multiplier is applied one or more times until the threshold value is met. Once the threshold is met, the reel-game sub-feature can be terminated and the game can return to the first-level feature. For instance, the game can return to the primary feature, as shown in FIGS. 6A through 6D until the terminating event is achieved. In further embodiments, one or more additional re-spins are awarded after the threshold is reached, but the number of additional re-spins can be limited to a particular number (e.g., one additional re-spin).

IV.C. Example General Embodiments of the Disclosed Technology.

Figure 11:
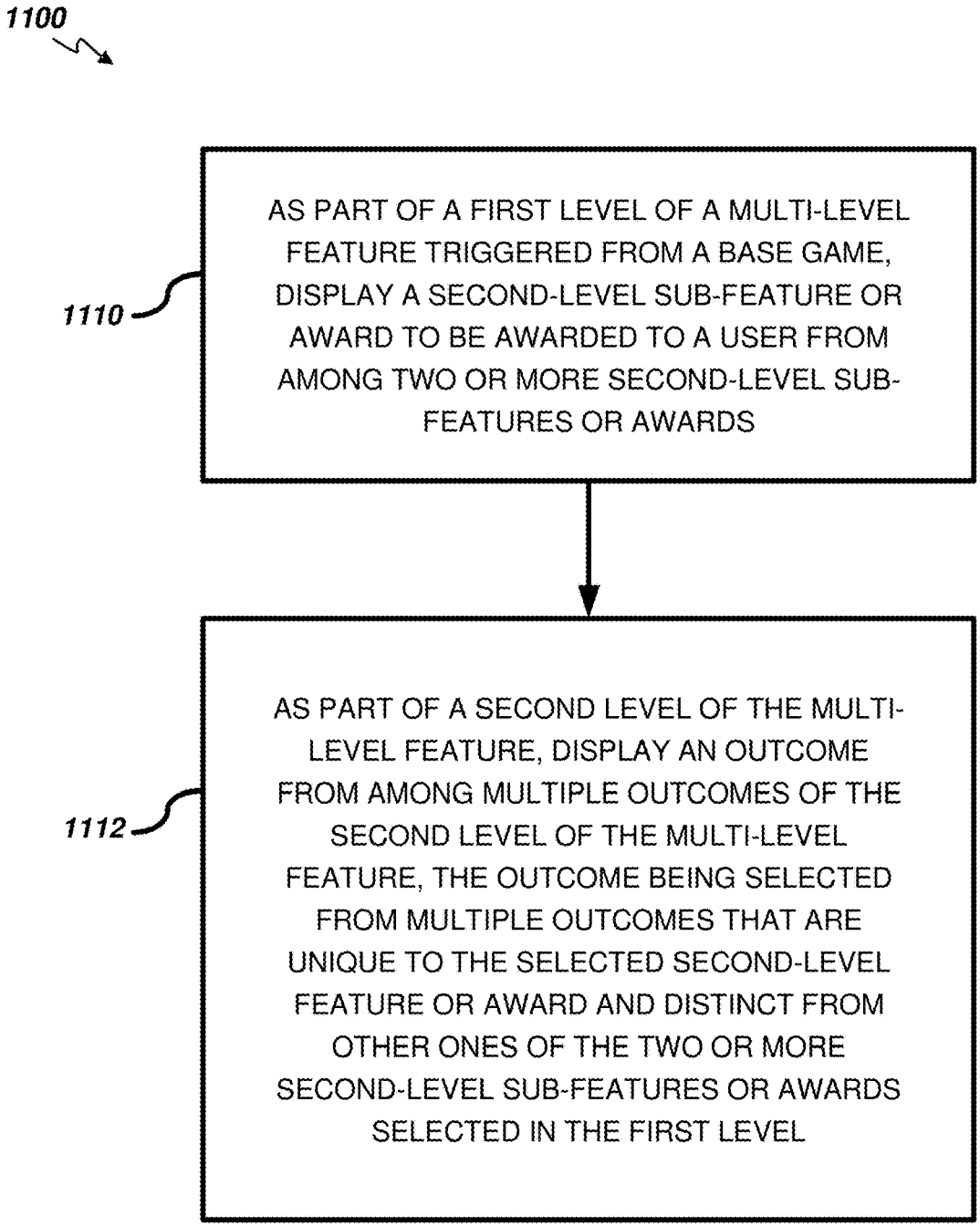

FIG. 11 is a flow chart 1100 illustrating an example embodiment for controlling and/or providing progressive game play data to an electronic gaming machine ("EGM"). In particular, the method of FIG. 11 can be performed by a game controller of the EGM or an EGM server in communication with an EGM. Although the illustrated method is described in a particular, sequential order, it should be understood that this manner of description encompasses rearrangement. For example, operations described sequentially may in some cases be rearranged or performed concurrently.

At 1110, an indication that a multi-level feature has been triggered at an EGM is received. In some implementations, for example, the multi-level feature is triggered via a symbol-driven combination being achieved in a base game at the EGM. In other implementations, the multi-level feature is triggered via a random trigger process.

At 1112, in a first level of the multi-level feature, a second-level sub-feature or award is selected to be awarded to a user from among two or more available second-level sub-features or awards.

At 1114, in a second level of the multi-level feature, and for the selected second-level sub-feature or award, an outcome is selected from among multiple outcomes of the second level of the multi-level feature, the outcome being selected from multiple outcomes that are unique to the selected second-level feature or award and distinct from other ones of the two or more second-level sub-features or awards selected in the first level.

In certain implementations, the selecting the second-level sub-feature or award is performed by a random-selection technique that randomly selects one of a plurality of sub-features and/or awards to be awarded to the user. For example, the one or more of the plurality of sub-features and/or awards can be weighted to be selected with a higher or lower probability with respect to one or more other ones of the plurality of sub-features and/or awards.

With respect to the second level of the multi-level feature, in some implementations, the selecting an outcome from among multiple outcomes of the second level of the multi-level feature is performed by a random-selection technique that randomly selects an outcome from among the multiple outcomes. For example, the selected outcome can be weighted to be selected with a higher or lower probability with respect to one or more other ones of the multiple outcomes.

Further embodiments comprise displaying an outcome from the selecting the second-level sub-feature or award to a user. For example, the displaying the outcome from the selecting the second-level sub-feature or award can be presented to the user as a primary wheel animated to spin and stop at a pointer pointing to the selected second-level sub-feature or award. Still further, embodiments of the disclosed technology can comprise displaying an outcome from the selecting an outcome from among multiple outcomes of the second level of the multi-level feature. For example, the displaying the outcome from the selecting the second-level sub-feature or award can be presented to the user as a secondary wheel animated to spin and stop at a pointer pointing to the selected outcome of the second level from among multiple outcomes of the second level of the multi-level feature.

Figure 12:
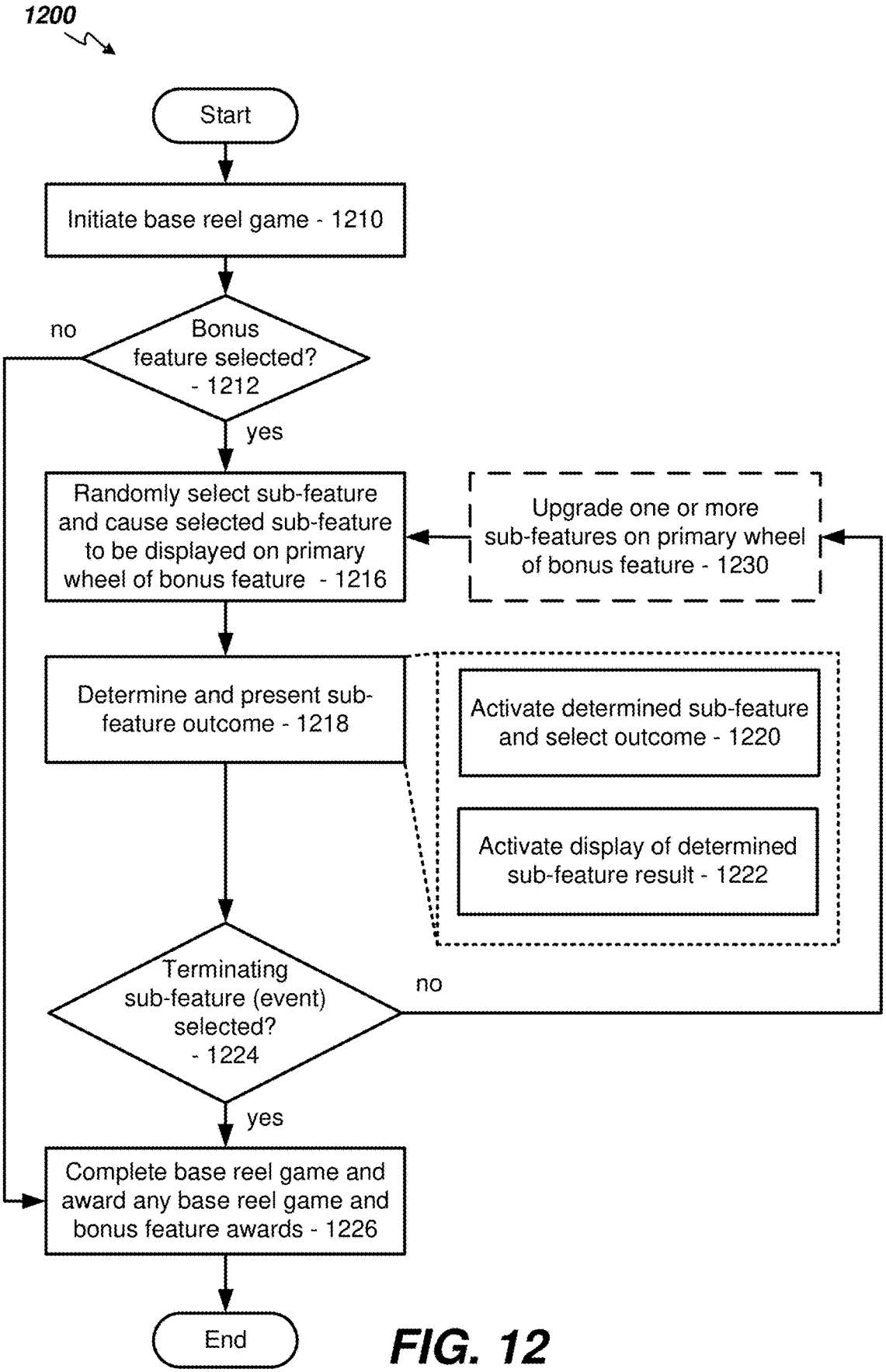

FIG. 12 is a flow chart 1200 illustrating an example embodiment for controlling and/or providing progressive game play data to an electronic gaming machine ("EGM"). In particular, the method of FIG. 12 can be performed by a game controller of the EGM or an EGM server in communication with an EGM. Although the illustrated method is described in a particular, sequential order, it should be understood that this manner of description encompasses rearrangement. For example, operations described sequentially may in some cases be rearranged or performed concurrently.

At 1210, as part of a first level of a multi-level feature triggered from a base game, a second-level sub-feature or award to be awarded to a user is displayed from among two or more second-level sub-features or awards;

At 1212, as part of a second level of the multi-level feature, an outcome from among multiple outcomes of the second level of the multi-level feature is displayed, the outcome being selected from multiple outcomes that are unique to the selected second-level feature or award and distinct from other ones of the two or more second-level sub-features or awards selected in the first level.

In some implementations, the displaying the second-level sub-feature or award is presented to the user as a primary wheel animated to spin and stop at a position indicating the selected second-level sub-feature or award.

In certain implementations, the displaying the outcome from among the multiple outcomes of the second level of the multi-level feature is presented to the user as a secondary wheel animated to spin and stop at a position indicating the selected outcome from among the multiple outcomes of the second level of the multi-level feature.

The second-level sub-feature or award can be selected by a random-selection technique that randomly selects one of a plurality of sub-features and/or awards to be awarded to the user, and wherein one or more of the plurality of sub-features and/or awards are weighted to be selected with a higher or lower probability with respect to one or more other ones of the plurality of sub-features and/or awards.

The outcome from among multiple outcomes of the second level of the multi-level feature can be selected by a random-selection technique that randomly selects an outcome from among the multiple outcomes, and/or wherein the selected outcome is weighted to be selected with a higher or lower probability with respect to one or more other ones of the multiple outcomes.

Depending on the implementation, various form factors of EGMs can incorporate these innovations. For example, for a "thick client" implementation, an EGM (such as a gaming device 104A-X in FIG. 1 or gaming device 200 in FIG. 2) stores computer-executable instructions for controlling one or more wagering games in local memory of the EGM and executes those instructions in one or more local processors of the EGM. The computer-executable instructions for controlling the game(s) may be stored within the EGM (e.g., at a factory) prior to installation of the EGM at a gaming establishment. Or, the computer-executable instructions for controlling the game(s) may be stored within the EGM after installation of the EGM at a gaming establishment (e.g., by downloading the instructions to the EGM over a network, or by installing memory that stores the instructions into the EGM, then configuring the EGM). In such a "thick client" implementation, a game controller of the EGM conducts one of the wagering game(s) and manages various interfaces of the EGM to receive player inputs and commands Or, as another example, for a "thin client" implementation, computer-executable instructions for controlling one or more wagering games are stored in memory of a gaming server (e.g., central determination gaming system server or other remote host) and executed in one or more processors of the gaming server. The game server remotely controls one of the wagering game(s) over a network, and the EGM displays screens for the wagering game and manages interfaces to receive player inputs and commands.

Still further, any of the disclosed embodiments can be implemented in a single EGM offering one or more progressive jackpot awards or in a linked system comprising multiple EGMs. In such linked systems, the progressive jackpot awards can be controlled by a central progressive controller.

FIG. 12 is a flow chart 1200 illustrating an example embodiment for controlling an electronic gaming machine ("EGM"). In particular, the method of FIG. 12 can be performed by a game controller of the EGM or an EGM server in communication with an EGM. Although the illustrated method is described in a particular, sequential order, it should be understood that this manner of description encompasses rearrangement. For example, operations described sequentially may in some cases be rearranged or performed concurrently. Further, in the illustrated embodiment, the method can be performed either by: (a) a stand-alone electronic gaming machine configured to perform any one or more of the disclosed method acts; (b) a back-end computing server communicating with a front-end electronic gaming machine to provide the described game flow; or (c) any combination or sub-combination of (a) or (b), as those skilled in the art will appreciate.

At 1210, a base reel game is initiated. For example, a player may initiate a game with a selected bet.

At 1212, the base game results are selected by an RNG and a determination is made as to whether a bonus feature has been achieved. For example, and as discussed above with respect to FIG. 4, one or more bonus symbols may be selected in the base game to trigger a bonus feature.

At 1216, the bonus feature is activated and, as part of the bonus feature, a sub-feature is selected from among multiple available sub-features. As discussed above with respect to FIGS. 6A-6D, the bonus feature can include one or more sub-features that trigger a further secondary RNG selection. For example, the one or more sub-features can include one or more of (a) a credit awarding secondary feature in which a secondary RNG is applied to select the amount of credits; (b) a free-spin secondary feature in which one or more free games can be awarded (as shown in FIGS. 7A-7E); and/or (c) a reel-spin feature in which an enhanced reward scheme is applied. In particular embodiments, the reel-spin feature can further include a random selection of a threshold that ensures the player the award of the threshold amount until it is exceeded by the game mechanics, as described above with respect to FIGS. 8 and 9A-9G.

At 1218, the outcome of the selected sub-feature from 1216 is determined and presented to the player. In particular, the determined sub-feature is activated and a resulting outcome is selected (e.g., using an RNG applying a lookup table, which may be weighted (as described above)). Subsequently, a display of the determined result of the sub-feature is activated at 1222.

At 1224, a determination is made as to whether the sub-feature selected is a terminating sub-feature (indicating that the bonus feature is to be terminated, and a return to the base reel game (after awarding any bonus feature credits are awarded) is to be executed). If a terminating sub-feature has not been selected, then the procedure (in this example) proceeds to 1230.

At 1230, one or more modifications are made to the primary wheel, which awards the sub-features. For instance, in the illustrated embodiment, one or more of the available sub-features are altered to provide greater awards; although, in some embodiments, lesser awards could be awarded. In particular embodiments, the upgrades include upgraded multipliers for the credit awarding sub-features (e.g., as shown in FIG. 6D) and/or upgraded reel strips for one or more bonus features (e.g., as explained above with respect to FIGS. 9A-9E). The number of possible upgrades can be limited, such that only n upgrades are possible (where n is any integer number, but may be set to have a limit, in which no further upgrades are available)

In the event that a terminating sub-feature (or event) is reached, then, at 1226, the particular game instance of the base reel game is completed and any base reel game and bonus feature awards are awarded to the player and added to the player's credit meter.

Figure 13:
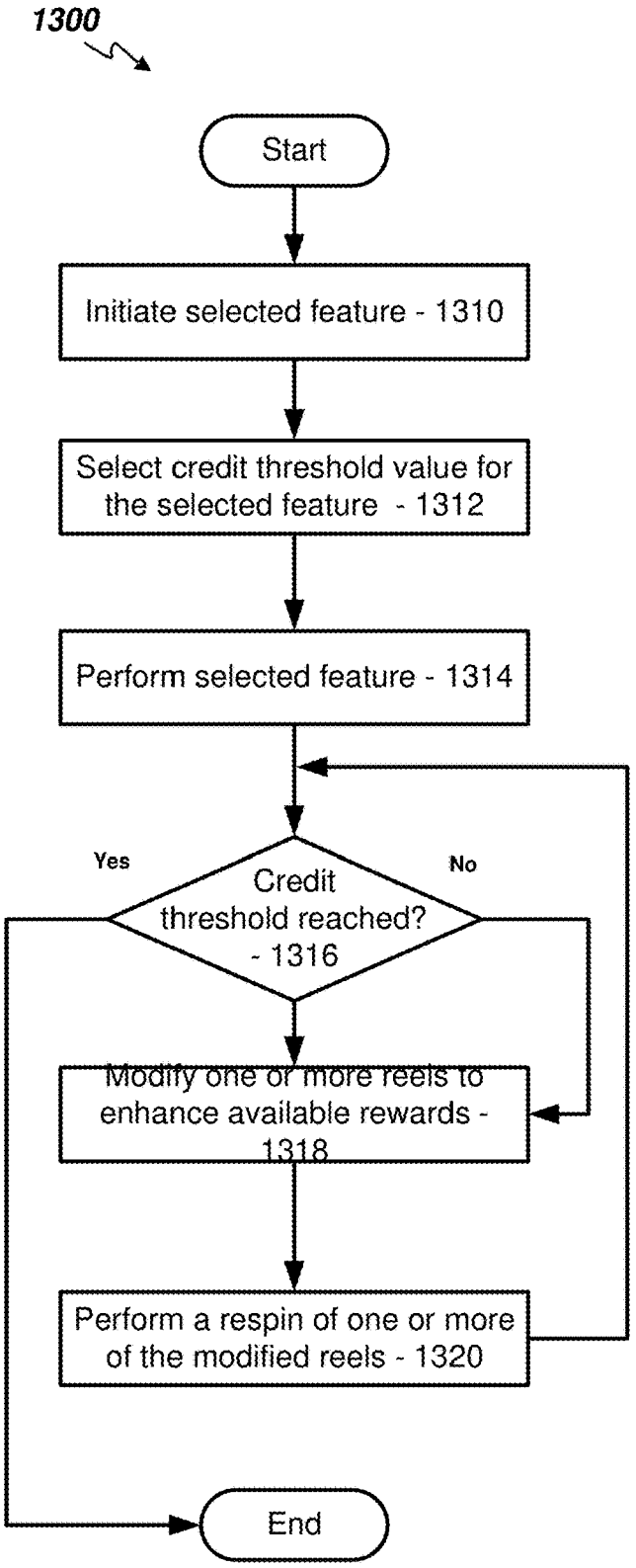

FIG. 13 is a flow chart 1300 illustrating an example embodiment for controlling an electronic gaming machine ("EGM"). In particular, the method of FIG. 13 can be performed by a game controller of the EGM or an EGM server in communication with an EGM. Although the illustrated method is described in a particular, sequential order, it should be understood that this manner of description encompasses rearrangement. For example, operations described sequentially may in some cases be rearranged or performed concurrently. Further, in the illustrated embodiment, the method can be performed either by: (a) a stand-alone electronic gaming machine configured to perform any one or more of the disclosed method acts; (b) a back-end computing server communicating with a front-end electronic gaming machine to provide the described game flow; or (c) any combination or sub-combination of (a) or (b), as those skilled in the art will appreciate.

At 1310, a selected feature is initiated.

At 1312, a threshold value for the selected feature is selected. The threshold value can be selected using an RNG. The RNG can be applied, for example, to a lookup table that describes the relative probabilities of various outcomes.

At 1314, the selected feature (such as the High Octane feature, as described herein) is performed. In certain embodiments, the selected feature is performed with the selected threshold value determined (e.g., from 1312).

At 1316, a determination is made as to whether the credit threshold has been met (e.g., the credit threshold from 1316). If so, then the process ends; if not, then the process proceeds to 1318, where one or more of the reels (which can be individual reels) are modified.

At 1320, a respin of the one or more modified reels is performed. For example, one or more of the reels that did not initially land on a bonus symbol in the displayed reel area can be respun (e.g., an RNG based on a lookup table can be called to produce a result that is displayed to the user). In particular embodiments, the respun reels can apply a modified reel (e.g., a reel that is enhanced (e.g., more beneficial to the player), and in some cases, a reel that guarantees an award from the reel (for example, by using a reel strip for the modified reel that will always include an award). In the illustrated example, the procedure then returns to 1316.

Figure 14:
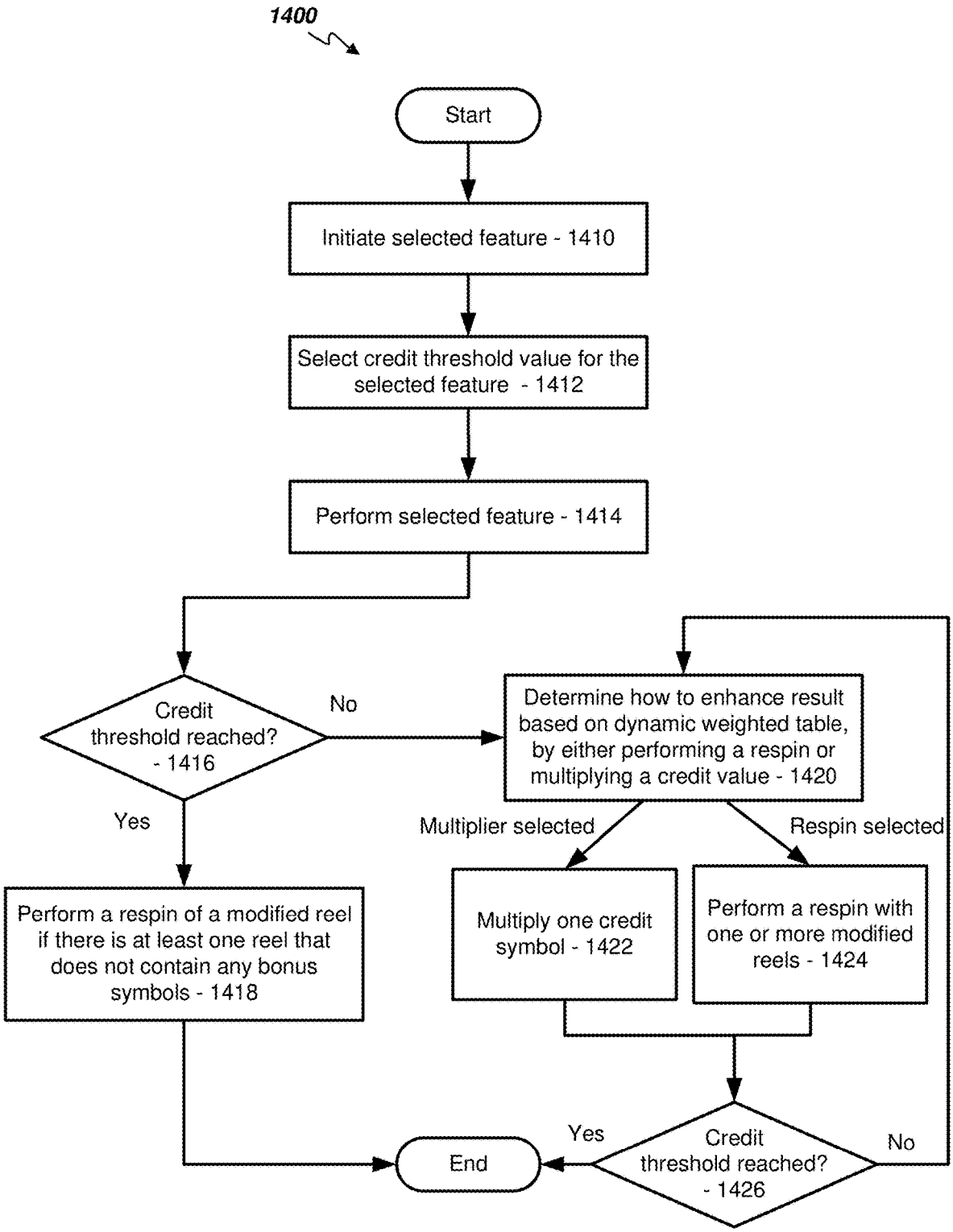

FIG. 14 is a flow chart 1400 illustrating a further example embodiment for controlling an electronic gaming machine ("EGM"). In particular, the method is a more specific example of FIG. 13 for implementing a selected feature (e.g., the "High Octane" bonus) the method of FIG. 14 can be performed by a game controller of the EGM or a server in communication with an EGM. Although the illustrated method is described in a particular, sequential order, it should be understood that this manner of description encompasses rearrangement. For example, operations described sequentially may in some cases be rearranged or performed concurrently. Further, in the illustrated embodiment, the method can be performed either by: (a) a stand-alone electronic gaming machine configured to perform any one or more of the disclosed method acts; (b) a back-end computing server communicating with a front-end electronic gaming machine to provide the described game flow; or (c) any combination or sub-combination of (a) or (b), as those skilled in the art will appreciate.

At 1410, a selected feature is initiated.

At 1412, a threshold value for the selected feature is selected. The threshold value can be selected using an RNG. The RNG can be applied, for example, to a lookup table that describes the relative probabilities of various outcomes.

At 1414, the selected feature (such as the High Octane feature, as described herein) is performed. In certain embodiments, the selected feature is performed with the selected threshold value (e.g., from 1412).

At 1416, a determination is made as to whether a credit threshold has already been met. If so, then the process proceeds to 1418; if not, then the process proceeds to 1420.

At 1420, a determination is made as to how to enhance a feature result. In the illustrated embodiment, enhancement can be made by performing one or more respins (e.g., of a particular reel, such a reel that initially landed on only blank symbols) or multiplying a credit value of one or more of the credit symbols that appear on one or more of the reels. Other enhancement mechanisms are also possible. If the multiplier enhancement is selected, then the process proceeds to 1422; if the respin enhancement is selected, then the process continues at 1424.

At 1422, one of the credit symbols that has landed in the previous spin is enhanced by a multiplier. In particular implementations, the credit symbol enhanced can be randomly selected from those credit symbols that have landed in the reel area. Further, the applied multiplier can be randomly selected from among a range of multipliers or fixed. In other embodiments, multiple credit symbols can be selected for a multiplier, and each selected credit symbol can be subject to either a same (randomly selected or fixed) multiplier or a unique multiplier (randomly selected or selected) for a respective credit symbol. The process then continues at 1426.

At 1424, a respin of one or more of the reels is performed. For example, the respun reel can be a reel that initially landed on all blanks. Still further, and as illustrated, the reel can be modified to increase the likelihood of a credit symbol or other symbol landing (such as a trigger symbol). In some implementations, the modified reel is guaranteed to provide at least one of a credit symbol or trigger symbol after respinning. The procedure then continues at 1426.

At 1426, a determination is made as to whether the credit threshold has now been reached after the enhancement procedure of 1420 and either 1422 or 1424. If so, then the feature ends; if not then 1420 is repeated. When repeated, 1420 can further enhance the reels (e.g., offer higher multipliers or additional respins). Still further, in some embodiments, there may be a maximum enhancement level for either 1422 or 1424.

Returning to 1418, a respin is performed. In this particular embodiment, the respin is performed for a reel that did not land on any bonus symbol (such as a credit symbol or a trigger symbol). Still further, the reel that is respun can be a modified reel with enhanced probability of an award. The feature then ends.

FIG. 15 is a flow chart 1500 illustrating a further example embodiment for controlling an electronic gaming machine ("EGM"). In particular, the method is a further specific example of the embodiment of FIG. 13 for implementing a selected feature (e.g., the "High Octane" bonus). The method of FIG. 15 can be performed by a game controller of the EGM or an EGM server in communication with an EGM. In Although the illustrated method is described in a particular, sequential order, it should be understood that this manner of description encompasses rearrangement. For example, operations described sequentially may in some cases be rearranged or performed concurrently. Further, in the illustrated embodiment, the method can be performed either by: (a) a stand-alone electronic gaming machine configured to perform any one or more of the disclosed method acts; (b) a back-end computing server communicating with a front-end electronic gaming machine to provide the described game flow; or (c) any combination or sub-combination of (a) or (b), as those skilled in the art will appreciate.

At 1510, the example feature (also referenced in FIG. 15 as the "spin improvement process" is started). As explained above, the spin improvement process can be triggered after an initial feature is completed (e.g., as a selection from a primary wheel).

At 1512, a determination is made as to whether a credit threshold value has been met. If so, then the process proceeds to 1514; if not, then the process proceeds to 1516.

In the disclosed embodiment, reel weights are set dynamically (e.g., each time the process iterates). In the illustrated embodiment, and at 1514 and 1516, one or more improvement weights are set. In the illustrated example, the improvement weights are variables that are used at 1520 to determine a possible award feature.

At 1514, the "blank respin" weight is assigned the number of blank reels (reels that landed on all blanks in the displayed reel area). This is shown in 1514 as "No. of blank reel=blank respin". The process then proceeds to 1518.

At 1516 the "blank respin" weight is assigned the number of blank reels (reels that landed on all blanks) multiplied by 3. This is shown in 1516 as "No. of blank reels*3=Blank Respin". Additionally, in 1516, a "credit boost" weight is assigned. In the example embodiment, the "credit boost" weight is assigned the number of credit spots that landed in the previous spin. The process then proceeds to 1518.

Process block 1516 thus operates to increase the possibility of the credit awards on a given reel, thereby increasing the likelihood that the threshold will be reached. Further, process block 1514, which only assigns a blank respin weight (meaning that the credit boost weight will be "0") operates to ensure the user one final respin of a blank reel even though the threshold has already been met.

Still further, in the illustrated embodiment, any reel with a trigger symbol ("TR") is considered as not blank. The trigger symbol can be a thematic symbol (such as the "Doof Warrior" in the illustrated "Mad Max" themed game). Still further, the trigger symbol may appear only on certain reels, and such trigger symbol reels may be swapped in when certain criteria are reached, as shown below in process blocks 1526 and 1530. In this example embodiment, the trigger symbol always appears in reel 1 and may appear in reel 5 when certain criteria are achieved.

At 1518, a determination is made as to whether an improvement is possible. For example, and as explained above, in certain embodiments, there is a limited number of possible improvements in this feature. Accordingly, at 1518, a determination is made as to whether the maximum threshold has already been met. If improvement is possible, then the process proceeds to 1520; if not, then the process proceeds to 1560, where the process ends.

At 1520, a random selection is made based on the selected weights as to whether to proceed to a blank respin subprocess (1522-1532) or a credit boost subprocess (1540-1544).

If the blank respin subprocess is triggered, then the blank respin subprocess is started at 1522. In the example respin subprocess explained below, FULL_REEL and FULL_TR_

REEL are reel strip variations that will guarantee a credit symbol will land after a respin in the case of FULL_REEL or guarantee that a credit symbol, a TR symbol, or both will land after a respin in the case of FULL_TR_REEL. In this particular example implementation, FULL_TR_REEL is only used for reel 5 and FULL_REEL is only used for reels 2, 3 and 4. It should be understood, however, than any one or more reels can be selected for availability of the FULL_REEL or FULL_TR_REEL.

At 1524, a blank reel is randomly selected. At 1526, a determination is made as to whether reel 5 was selected. If so, then the subprocess proceeds to 1530; if not, then the subprocess proceeds to 1528.

At 1530, the reel strip on reel 5 is upgraded to a reel strip that may result in the trigger symbol "TR" landing upon a respin (represented by "FULL_TR_REEL"), thereby guaranteeing an enhanced award when the respin is performed. The subprocess then proceeds to 1532.

At 1528, the reel strip on the selected reel is upgraded to a reel that guarantees the landing of a credit symbol upon a respin (represented by "FULL_REEL").

At 1532, the selected reel is respun and the subprocess proceeds to 1550.

If the credit boost subprocess is triggered, then the credit boost subprocess is started at 1540. At 1542, a credit spot is randomly selected. At 1544, a boost multiplier (e.g., 2, 3, 4, 5, or 7) is randomly selected and applied to the credit spot selected from 1542. The subprocess then proceeds to 1550.

At 1550, the spin result is internally evaluated, but not awarded. Further, in this particular embodiment, all boosted pays and any multipliers are considered.

At 1552, a determination is made as to whether the credit threshold has now been met by virtue of the improvement process and resulting respin. If the credit threshold has been met, then the overall process of FIG. 15 ends at 1560; if not, then the process returns to 1516 for a possible further improvement and re-iteration of the improvement process.

V. Alternatives, Variations, and Conclusion

Numerous embodiments are described in this disclosure, and are presented for illustrative purposes only. The described embodiments are not, and are not intended to be, limiting in any sense. The present disclosure is widely applicable to numerous embodiments, as is readily apparent from the disclosure. One of ordinary skill in the art will recognize that the innovations described herein may be practiced with various modifications and alterations, such as structural, logical, software, and electrical modifications. Although particular features of the innovations described herein may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the innovations described herein that must be present in all embodiments.

The Title (set forth at the beginning of the first page of this disclosure) is not to be taken as limiting in any way as the scope of the disclosed embodiments.

When an ordinal number (such as "first," "second," "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget." Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget"" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

When a single device, component, structure, or article is described herein, more than one device, component, structure or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component, structure, or article is described herein (whether or not they cooperate), a single device, component, structure, or article may alternatively be used in place of the more than one device, component, structure, or article that is described. For example, a plurality of computer-based devices may be substituted with a single computer-based device. Accordingly, the various functionality that is described as being possessed by more than one device, component, structure, or article may alternatively be possessed by a single device, component, structure, or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the innovations described herein. Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the innovations described herein, and does not imply that the illustrated process is preferred.

Although a process may be described as including a plurality of steps, that does not indicate that all or even any of the steps are essential or required. Various other embodiments within the scope of the present disclosure include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the present disclosure include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

For the sake of presentation, the detailed description uses terms like "determine" and "select" to describe computer operations in a computer system. These terms denote operations performed by a computer, and should not be confused with acts performed by a human being. The actual computer operations corresponding to these terms vary depending on implementation. For example, "determining" something can be performed in a variety of manners, and therefore the term "determining" (and like terms) can indicate calculating, computing, deriving, looking up (e.g., in a table, database or data structure), ascertaining, recognizing, and the like.

As used herein, the term "send" denotes any way of conveying information from one component to another component, and the term "receive" denotes any way of getting information at one component from another component. The two components can be part of the same computer system or different computer systems. The information can be passed by value (e.g., as a parameter of a message or function call) or passed by reference (e.g., in a buffer). Depending on context, the information can be communicated directly between the two components or be conveyed through one or more intermediate components. As used herein, the term "connected" denotes an operable communication link between two components, which can be part of the same computer system or different computer systems. The operable communication link can be a wired or wireless network connection, which can be direct or pass through one or more intermediate components (e.g., of a network). Communication among computers and devices may be encrypted to insure privacy and prevent fraud in any of a variety of ways well known in the art.

It will be readily apparent that the various methods and algorithms described herein may be implemented by, e.g., appropriately programmed general-purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium for performing the process. The apparatus that performs the process can include components and devices (e.g., a processor, input and output devices) appropriate to perform the process. A computer-readable medium can store program elements appropriate to perform the method.

The term "computer-readable medium" refers to any non-transitory storage or memory that may store computer-executable instructions or other data in a computer system and be read by a processor in the computer system. A computer-readable medium may take many forms, including but not limited to non-volatile storage or memory (such as optical or magnetic disk media, a solid-state drive, a flash drive, PROM, EPROM, and other persistent memory) and volatile memory (such as DRAM). The term "computer-readable media" excludes signals, waves, and wave forms or other intangible or transitory media that may nevertheless be readable by a computer.

The present disclosure provides, to one of ordinary skill in the art, an enabling description of several embodiments and/or innovations. Some of these embodiments and/or innovations may not be claimed in the present application, but may nevertheless be claimed in one or more continuing applications that claim the benefit of priority of the present application. Applicants may file additional applications to pursue patents for subject matter that has been disclosed and enabled but not claimed in the present application.

The foregoing description discloses only exemplary embodiments of the present disclosure. Modifications of the above disclosed apparatus and methods which fall within the scope of the present disclosure will be readily apparent to those of ordinary skill in the art. For example, although the examples discussed above are illustrated for a gaming market, embodiments of the present disclosure can be implemented for other markets. The gaming system environment of the examples is not intended to suggest any limitation as to the scope of use or functionality of any aspect of the disclosure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A system comprising:

one or more processors;

memory; and control logic, implemented using the one or more processors and memory, configured to perform operations to manage volatility for a target level of return to player for a multi-level feature of an electronic gaming device, the operations comprising:

receiving an indication that a multi-level feature has been triggered at the electronic gaming device;

in a first level of the multi-level feature, repeatedly selecting, using a random number generator, a first-level outcome from among multiple first-level outcomes until the selected first-level outcome is one of multiple second-level sub-features or awards, the multiple first-level outcomes including the multiple second-level sub-features or awards as well as one or more other first-level outcomes, wherein, upon selection of one of the one or more other first-level outcomes, at least one of the multiple second-level sub-features or awards is enhanced as part of achieving increased volatility for the target level of return to player for the multi-level feature; and in a second level of the multi-level feature, and based on the selected second-level sub-feature or award, selecting, using the random number generator, a second-level outcome from among multiple second-level outcomes of the second level of the multi-level feature, the second-level outcome being selected from multiple second-level outcomes that are unique to the selected second-level feature or award and distinct from other ones of the multiple second-level sub-features or awards available in the first level of the multi-level feature.

2. The system of claim 1, wherein the multi-level feature is triggered via a symbol-driven combination being achieved in a base game at the electronic gaming device.

3. The system of claim 1, wherein the multi-level feature is triggered via a random trigger process.

4. The system of claim 1, wherein the selecting the first-level outcome is performed by a random-selection technique that randomly selects one of the multiple first-level outcomes in accordance with a lookup table.

5. The system of claim 1, wherein each of the multiple second-level sub-features or awards is a terminating event for the first level of the multi-level feature, and wherein each of the one or more other first-level outcomes is a non-terminating event for the first level of the multi-level feature.

6. The system of claim 5, wherein the terminating event is selection of a free spin sub-feature in which one or more free spins are awarded, a credit award sub-feature in which an amount of credits is awarded, or a reel spin sub-feature with an enhanced reward scheme.

7. The system of claim 5, wherein, upon selection of one of the one or more other first-level outcomes, the at least one of the multiple second-level sub-features or awards is enhanced by upgrading one or more reel strips for a free spin sub-feature, upgrading a multiplier for a credit award sub-feature, or upgrading one or more reel strips for a reel spin sub-feature.

8. The system of claim 1, and wherein the multiple first-level outcomes are weighted to be selected with a higher or lower probability with respect to other ones of the multiple first-level outcomes.

9. The system of claim 1, wherein the selected first-level outcome is presented as a primary wheel animated to spin and stop at a pointer pointing to the selected first-level outcome from among the multiple first-level outcomes.

10. The system of claim 1, wherein the second-level outcome is presented as a secondary wheel animated to spin and stop at a pointer pointing to the selected second-level outcome from among the multiple second-level outcomes.

11. A system comprising:

one or more processors;

memory; and control logic, implemented using the one or more processors and memory, configured to perform operations to manage volatility for a target level of return to player for a bonus feature of an electronic gaming device, the operations comprising:

triggering a bonus feature based on an outcome of a primary game;

selecting a first-level outcome from among multiple first-level outcomes for the bonus feature, the multiple first-level outcomes including one or more terminating outcomes and one or more non-terminating outcomes;

determining that the selected first-level outcome is one of the one or more non-terminating outcomes;

upon determining that the selected first-level outcome is one of the one or more non-terminating outcomes, enhancing at least one of the one or more terminating outcomes as part of achieving increased volatility for the target level of return to player for the bonus feature; and re-performing the selecting the first-level outcome from among the multiple first-level outcomes for the bonus feature, the multiple first-level outcomes having been adjusted to include the enhanced at least one of the one or more terminating outcomes and to remove the previously selected first-level outcome that is one of the one or more non-terminating outcomes.

12. The system of claim 11, wherein selection of the first-level outcome is performed by a random-selection technique that randomly selects one of the multiple first-level outcomes, and wherein the one or more terminating outcomes are sub-features and/or awards to be awarded to the user.

13. The system of claim 11, the operations further comprising:

upon selection of one of the one or more terminating outcomes, displaying the terminating outcome as being from a single second-level wheel from among multiple second-level wheels.

14. The system of claim 13, wherein the single second-level wheel is visually presented in a different orientation than a display of the outcome of the first-level outcome.

15. The system of claim 11, wherein second-level outcomes associated with the selected terminating outcome are unique to the selected terminating outcome.

16. In an electronic gaming device, a method of managing volatility for a target level of return to player for a bonus feature of the electronic gaming device, the method comprising:

triggering a bonus feature based on an outcome of a primary game;

selecting a first-level outcome from among multiple first-level outcomes for the bonus feature, the multiple first-level outcomes including one or more terminating outcomes and one or more non-terminating outcomes;

determining that the selected first-level outcome is one of the one or more non-terminating outcomes;

upon determining that the selected first-level outcome is one of the one or more non-terminating outcomes, enhancing at least one of the one or more terminating outcomes as part of achieving increased volatility for the target level of return to player for the bonus feature; and re-performing the selecting the first-level outcome from among the multiple first-level outcomes for the bonus feature, the multiple first-level outcomes having been adjusted to include the enhanced at least one of the one or more terminating outcomes and to remove the previously selected first-level outcome that is one of the one or more non-terminating outcomes.

17. The method of claim 16, wherein selection of the first-level outcome is performed by a random-selection technique that randomly selects one of the multiple first-level outcomes, and wherein the one or more terminating outcomes are sub-features and/or awards to be awarded to the user.

18. The method of claim 16, further comprising, upon selection of one of the one or more terminating outcomes, displaying the terminating outcome as being from a single second-level wheel from among multiple second-level wheels.

19. The method of claim 18, wherein the single second-level wheel is visually presented in a different orientation than a display of the outcome of the first-level outcome.

20. The method of claim 16, wherein second-level outcomes associated with the selected terminating outcome are unique to the selected terminating outcome.

* * * * *